US009196469B2

(12) United States Patent
Makarov

(10) Patent No.: US 9,196,469 B2
(45) Date of Patent: Nov. 24, 2015

(54) CONSTRAINING ARCUATE DIVERGENCE IN AN ION MIRROR MASS ANALYSER

(75) Inventor: Alexander A. Makarov, Bremen (DE)

(73) Assignee: Thermo Fisher Scientific (Bremen) GmbH, Bremen (DE)

( * ) Notice: Subject to any disclaimer, the term of this patent is extended or adjusted under 35 U.S.C. 154(b) by 0 days.

(21) Appl. No.: 13/989,697

(22) PCT Filed: Nov. 24, 2011

(86) PCT No.: PCT/EP2011/070960

§ 371 (c)(1),
(2), (4) Date: May 24, 2013

(87) PCT Pub. No.: WO2012/069596

PCT Pub. Date: May 31, 2012

(65) Prior Publication Data

US 2013/0240725 A1 Sep. 19, 2013

(30) Foreign Application Priority Data

Nov. 26, 2010 (GB) ..... 1020038.4

(51) Int. Cl.
*H01J 49/34* (2006.01)
*H01J 49/40* (2006.01)
*H01J 49/42* (2006.01)

(52) U.S. Cl.
CPC ..... *H01J 49/405* (2013.01); *H01J 49/427* (2013.01); *H01J 49/4245* (2013.01)

(58) Field of Classification Search
CPC ..... H01J 49/02; H01J 49/425; H01J 49/406
See application file for complete search history.

(56) References Cited

U.S. PATENT DOCUMENTS 6,013,913 A * 1/2000 Hanson ..... 250/287
6,570,152 B1 * 5/2003 Hoyes ..... 250/287

(Continued)

FOREIGN PATENT DOCUMENTS

GB 2470259 A 11/2010
GB 2470599 A 12/2010

(Continued)

*Primary Examiner* — Brooke Purinton
(74) *Attorney, Agent, or Firm* — Nicholas Cairns

(57) ABSTRACT

A method of selecting ions of interest from a beam of ions using an analyzer, the method comprising: (i) providing an analyzer comprising two opposing ion mirrors each mirror comprising inner and outer field-defining electrode systems elongated along an analyzer axis z, each system comprising one or more electrodes, the outer system surrounding the inner; (ii) causing the beam of ions to fly through the analyzer along a main flight path in the presence of an analyzer field so as to undergo within the analyzer at least one full oscillation in the direction of the analyzer axis while orbiting about or oscillating between one or more electrodes of the inner field defining electrode system; (iii) providing one or more sets of electrodes adjacent the main flight path; (iv) constraining the arcuate divergence from the main flight path of ions of interest by applying one set of voltages to one or more of the sets of electrodes adjacent the main flight path when the ions of interest are in the vicinity of at least one of said one or more sets of electrodes adjacent the main flight path and applying one or more different sets of voltages to the said one or more sets of electrodes adjacent the main flight path when the ions of interest are not in the vicinity of at least one of said one or more sets of electrodes adjacent the main flight path; and: (v) ejecting the ions of interest from the analyzer. Also provided is a charged particle analyzer comprising the two opposing ion mirrors comprising inner and outer field-defining electrode systems elongated along an analyzer axis z; and at least one arcuate focusing lens for constraining the arcuate divergence of a beam of charged particles within the analyzer while the beam orbits around the axis z, the analyzer further comprising a disc having two faces at least partly spanning the space between the inner and outer field defining electrode systems and lying in a plane perpendicular to the axis z, the disc having resistive coating upon both faces.

24 Claims, 11 Drawing Sheets

(56) References Cited

U.S. PATENT DOCUMENTS

| | | | | |
|---|---|---|---|---|
| 6,888,130 | B1 | 5/2005 | Gonin | |
| 7,439,520 | B2 * | 10/2008 | Vestal | 250/305 |
| 8,384,019 | B2 * | 2/2013 | Koster et al. | 250/281 |
| 2006/0151694 | A1 * | 7/2006 | Guevremont et al. | 250/292 |
| 2008/0203293 | A1 | 8/2008 | Makarov | |
| 2008/0315080 | A1 * | 12/2008 | Makarov et al. | 250/281 |
| 2010/0301204 | A1 * | 12/2010 | Koster et al. | 250/283 |

FOREIGN PATENT DOCUMENTS

| | | | |
|---|---|---|---|
| GB | 2470600 | A | 12/2010 |
| WO | WO 2010/136534 | A1 | 12/2010 |

* cited by examiner

CONSTRAINING ARCUATE DIVERGENCE IN AN ION MIRROR MASS ANALYSER

FIELD OF THE INVENTION

This invention relates to the field of mass selecting ions, and in particular to methods and apparatus for the selection of ions within time of flight multi-reflection mass spectrometers.

BACKGROUND

Time of flight (TOF) mass spectrometers are widely used to determine the mass to charge ratio of charged particles on the basis of their flight time along a path. The charged particles, usually ions, are emitted from a pulsed source in the form of a packet, and are directed along a prescribed flight path through an evacuated space to impinge upon or pass through a detector. (Herein ions will be used as an example of charged particles.) In its simplest form, the path follows a straight line and in this case ions leaving the source with a constant kinetic energy reach the detector after a time which depends upon their mass to charge ratio, more massive ions being slower. The difference in flight times between ions of different mass-to-charge ratio depends upon the length of the flight path, amongst other things; longer flight paths increasing the time difference, which leads to an increase in mass resolution. When high mass resolution is required it is therefore desirable to increase the flight path length. However, increases in a simple linear path length lead to an enlarged instrument size, increasing manufacturing cost and require more laboratory space to house the instrument.

Various solutions have been proposed to increase the path length whilst maintaining a practical instrument size, by utilising more complex flight paths. Many examples of charged particle mirrors or reflectors have been described, as have electric and magnetic sectors, some examples of which are given by H. Wollnik and M. Przewloka in the Journal of Mass Spectrometry and Ion Processes, 96 (1990) 267-274, and G. Weiss in U.S. Pat. No. 6,828,553. In some cases two opposing reflectors or mirrors direct charged particles repeatedly back and forth between the reflectors or mirrors; offset reflectors or mirrors cause ions to follow a folded path; sectors direct ions around in a ring or a figure of "8" racetrack. Herein the terms reflector and mirror are used interchangeably and both refer to ion mirrors or ion reflectors unless otherwise stated. Many such configurations have been studied and will be known to those skilled in the art.

Mass selectors are well known in the art and are usually used for selecting ions of a small range of mass to charge ratios (m/z), often of a single m/z, for further processing. Quadrupole, magnetic sector and ion trap mass analysers are the most commonly used mass selectors. Ions having a wide range of m/z are typically emitted from an ion source and mass spectra are complex. Furthermore there may be several possible molecular candidates for any given ion. As is well known, in order to elucidate the molecular structure of an ion species, the species in question (the parent ion) is often subjected to fragmentation and the fragment ions are mass analysed, in a process termed MS-MS. The mass to charge ratios of the ions from the fragmentation process are characteristic of the parent ion. It greatly aids the identification process if the parent ion alone is subjected to the fragmentation process, and this often requires high mass resolving power (RP) to select the parent ions before passing them to the fragmentor.

TOF mass analysers are ideally suited to separate ions of high mass to charge ratios and to transmit a separated train of ions to a detection system or to additional ion optical devices for further processing. However, conventional TOF analysers suffer from high ion losses and poor focusing of ions. A small TOF analyser will have only modest mass RP and yet may still require very high speed switching hardware to enable ions of a relatively large range of mass to charge ratios (m/z) to be selected by time of flight gating structures. Such small TOF analysers may be inadequate for selecting ions of a single m/z. An example of such mass selector is shown in WO97048120. Where high RP selection is required, typically a costly and bulky TOF would be required. Other types of mass selector such as linear quadrupole mass filters are typically employed instead, but they have limited mass RP and, where relatively high mass RP filters are used, they have relatively low transmission (typically, when required mass windows are below 0.1-0.2 a.m.u.). Magnetic sector mass selectors extend the mass RP available over that possible from quadrupole mass filters, but magnetic sectors are very bulky, massive and costly. Both quadrupole mass filters and magnetic sector mass analysers have limited upper mass range. TOF mass analysers have the potential to be used as mass selectors with largely unlimited upper mass range and high mass RP, but so far transmission has been relatively low, and as already mentioned, the analysers are bulky and costly.

There remains a need for a high mass RP, high transmission, wide mass range, compact and reduced cost mass selector. Against this background, the present invention has been made.

SUMMARY OF INVENTION

According to the present invention, in a first independent aspect, a method of selecting ions of interest from a beam of ions using an analyser is provided, the method comprising:

(i) providing an analyser comprising two opposing ion mirrors each mirror comprising inner and outer field-defining electrode systems elongated along an analyser axis z, each system comprising one or more electrodes, the outer system surrounding the inner;

(ii) causing the beam of ions to fly through the analyser along a main flight path in the presence of an analyser field so as to undergo within the analyser at least one full oscillation in the direction of the analyser axis whilst orbiting about or oscillating between one or more electrodes of the inner field defining electrode system;

(iii) providing one or more sets of electrodes adjacent the main flight path;

(iv) constraining the arcuate divergence from the main flight path of ions of interest by applying one set of voltages to one or more of the sets of electrodes adjacent the main flight path when the ions of interest are in the vicinity of at least one of said one or more sets of electrodes adjacent the main flight path and applying one or more different sets of voltages to the said one or more sets of electrodes adjacent the main flight path when the ions of interest are not in the vicinity of at least one of said one or more sets of electrodes adjacent the main flight path; and:

(v) ejecting the ions of interest from the analyser.

In another independent aspect the present invention provides a charged particle analyser comprising two opposing ion mirrors each mirror comprising inner and outer field-defining electrode systems elongated along an axis z, the outer system surrounding the inner, whereby when the electrode systems are electrically biased the mirrors create an electrical field comprising opposing electrical fields along z; and at least one arcuate focusing lens for constraining the arcuate divergence of a beam of charged particles within the analyser whilst the beam orbits around the axis z, the analyser further comprising a disc at least partly spanning the space between inner and outer field defining electrode systems and lying in a plane perpendicular to the axis z, the disc having two faces and resistive coating upon both faces.

In another independent aspect the present invention provides a method of separating ions of interest from unwanted ions within an ion packet, comprising injecting the packet of ions into an analyser; causing the packet of ions to separate according to their time of flight as they oscillate parallel to an axis z between two opposing ion mirrors within the analyser along a main flight path whilst at the same time orbiting or oscillating in a direction perpendicular to z; periodically applying arcuate focusing to constrain the arcuate divergence of the ions of interest, the arcuate direction being perpendicular to the axis z; periodically applying beam deflection to deflect unwanted ions from the main flight path; and ejecting the ions of interest from the analyser.

The method enables ions of interest to be selected from a beam of ions using an analyser, the beam of ions being injected into the analyser and comprising ions of a plurality of mass to charge ratios, some of which are ions of interest and some of which are unwanted ions. The method enables ions of one or more ranges of mass to charge ratio to be selectively ejected from the analyser whilst other, unwanted ions from the beam are not ejected or are not ejected in the same way.

The method preferably comprises periodically constraining the arcuate divergence of the ions of interest a plurality of times as they fly through the analyser and periodically deflecting unwanted ions from the main flight path as they fly through the analyser. The one or more different sets of voltages herein means different to the set of voltages for constraining the arcuate divergence from the main flight path of the ions of interest. The one or more different sets of voltages applied to the one or more sets of electrodes adjacent the main flight path when ions of interest are not in the vicinity of said one or more sets of electrodes adjacent the main flight path are preferably for deflecting unwanted ions from the main flight path.

The term arcuate is used herein to mean the angular direction around the longitudinal analyser axis z. FIG. 1 shows the respective directions of the analyser axis z, the radial direction r and the arcuate direction ø, which thus can be seen as cylindrical coordinates.

Analysers comprising two opposing ion mirrors each mirror comprising inner and outer field-defining electrode systems elongated along an analyser axis z are described in the applicant's pending patent applications PCT/EP2010/057340 and PCT/EP2010/057342, the entire contents of which are hereby incorporated by reference.

The one or more sets of electrodes adjacent the main flight path may be all the same in structure or they may differ from one another. Preferably all the one or more sets of electrodes adjacent the main flight path are similar to one another. Each set of electrodes adjacent the main flight may comprise one or more electrodes. Preferably each set of electrodes adjacent the main flight path comprises a pair of opposing electrodes, one electrode each side of the main flight path.

Herein a set of voltages means one or more voltages. The set of voltages for constraining the arcuate divergence from the main flight path of the ions of interest may be a first set of voltages. A second set of voltages may comprise one of the one or more different sets of voltages. The first set of voltages applied to the one or more sets of electrodes adjacent the main flight path is preferably applied to a first set of the one or more sets of electrodes adjacent the main flight path, and the second set of voltages applied to the one or more sets of sets of electrodes adjacent the main flight path is preferably applied to a second set of the one or more sets of electrodes adjacent the main flight path. The first set of the one or more sets of electrodes adjacent the main flight path may be the same as or may comprise the second set of the one or more sets of electrodes adjacent the main flight path or they may be different. Preferably the first set of the one or more sets of electrodes adjacent the main flight path is the same as the second set of the one or more sets of electrodes adjacent the main flight path, i.e. the one or more sets of electrodes adjacent the main flight path are preferably used for both constraining the arcuate divergence of the ions of interest and are used for deflecting unwanted ions from the main flight path.

Where the sets of electrodes adjacent the main flight path perform the function of constraining the arcuate divergence of the ions of interest whilst the ions of interest are in the vicinity of the said sets of electrodes adjacent the main flight path and whilst the sets of electrodes adjacent the main flight path have the first set of voltages applied to them, said sets of electrodes adjacent the main flight path comprise one or more arcuate focusing lenses. Preferably all the one or more sets of electrodes adjacent the main flight path comprise arcuate focusing lenses, though the said arcuate focusing lenses may be used both for constraining the arcuate divergence of ions of interest at some times, and deflecting unwanted ions from the main flight path at some other times. In other embodiments, some of the one or more sets of electrodes adjacent the main flight path comprise arcuate focusing lenses and other of the one or more sets of electrodes adjacent the main flight path comprise beam deflectors.

The method preferably comprises passing the ions of interest through or in the vicinity of the at least one arcuate focusing lens a plurality of times (e.g. through the arcuate focusing lens a plurality of times where there is only one arcuate focusing lens or through each lens one or more times where there is more than one arcuate focusing lens). Preferably, the apparatus comprises two arcuate focusing lenses. More preferably, the apparatus comprises a single arcuate focusing lens. Preferably the method comprises constraining the arcuate divergence of the ions of interest at least once as they pass through the analyser. Preferably, the constraining of the arcuate divergence of the ions of interest and/or the passing of the ions of interest through or in the vicinity of the at least one arcuate focusing lens is performed before the size of the packet containing ions of interest becomes larger than the dimension of the focusing lens in the arcuate direction.

Preferably, the ions of interest have their arcuate divergence constrained and/or pass through an arcuate focusing lens after substantially each oscillation between the mirrors, more preferably after substantially each reflection (half oscillation) from the mirrors.

Preferably, where there is a plurality of sets of electrodes adjacent the main flight path, the plurality of sets of electrodes adjacent the main flight path form an array of sets of electrodes adjacent the main flight path located at substantially the same z coordinate. Herein an array means two or more. More preferably, the array of sets of electrodes adjacent the main flight path is located at substantially the same z coordinate, which preferably is at or near z=0 but most preferably near z=0 but offset from z=0. The array of sets of electrodes adjacent the main flight path preferably extends at least partially around the z axis in the arcuate direction, more preferably substantially around the z axis in the arcuate direction. The sets of electrodes adjacent the main flight path are spaced apart in the arcuate direction. The spacing apart of the plurality of sets of electrodes adjacent the main flight path in the arcuate direction may be either regular or irregular, but is preferably regular, i.e. periodic.

In a preferred embodiment where there are two sets of electrodes adjacent the main flight path, preferably the two sets of electrodes adjacent the main flight path are on opposite sides of the z axis, spaced around the z axis in the arcuate direction; most preferably each arcuate focusing lens is located on a line passing through the z axis, i.e. the two sets of electrodes adjacent the main flight path are spaced around the z axis in the arcuate direction by 180 degrees.

Preferably, each of the at least one arcuate focusing lenses is formed from one or more electrodes held at a potential (i.e. by the voltages applied thereto), e.g. so as to provide an electric field perturbation in at least an arcuate direction, e.g. an electric field perturbation in three dimensions (3D). The electric field perturbation is thereby created by applying a set of voltages to the one or more sets of electrodes adjacent the main flight path.

The method comprises constraining the arcuate divergence of the ions of interest by applying one set of voltages to one or more of the sets of electrodes adjacent the main flight path when ions of interest are in the vicinity of said one or more sets of electrodes adjacent the main flight path and applying one or more different sets of voltages when ions of interest are not in the vicinity of said one or more sets of electrodes adjacent the main flight path. By this means preferentially the ions of interest undergo a first magnitude of arcuate focusing whilst within the analyser whilst other ions in the beam (i.e. unwanted ions) undergo a second magnitude of arcuate focusing whilst within the analyser. In the method of the present invention, the second magnitude of arcuate focusing is smaller than the first magnitude of arcuate focusing. The second magnitude of arcuate focusing may be substantially no focusing or substantial de-focusing. Preferably the second magnitude of arcuate focusing is substantially zero for most of the unwanted ions within the analyser.

As a packet of ions is injected into the analyser and undergoes motion along a main flight path (which will be further described), the ions begin to separate out along the flight path according to their mass to charge ratio. The packet of ions may have begun to separate out according to their mass to charge ratio even before entry to the analyser. Preferably the packet of ions has begun to separate out according to their mass to charge ratio even before entry to the analyser. Within the analyser, the ions will have separated out a finite amount before the ions of interest reach the first or only arcuate focusing lens. In the method of the present invention, when the ions of interest reach the vicinity of the first or only arcuate focusing lens the said lens will have a first set of voltages applied to it, causing an electric field perturbation in the vicinity of the lens. Accordingly the ions of interest will undergo a degree of arcuate focusing as they pass through the perturbed electric field. When the ions of interest have left the vicinity of the first or only arcuate focusing lens, a second set of voltages (different from the first set of voltages) is applied to the first or only arcuate focusing lens. Preferably the second set of voltages causes the first or only arcuate focusing lens to have a lesser arcuate focusing action, more preferably no focusing action, more preferably still a defocusing or disrupting action upon ions in its vicinity.

Depending upon the degree of separation between the ions of interest and the other, unwanted ions within the beam, some or all of the other unwanted ions within the beam may also receive a degree of arcuate focusing, because some or all of the other, unwanted ions may also be in the vicinity of the first or only arcuate focusing lens whilst the first set of voltages is applied to it. However, as the ions in the beam continue to follow the main flight path within the analyser they will reach another arcuate focusing lens, or the same arcuate focusing lens a second time. By this time the ions will have further separated out along the flight path according to their mass to charge ratio and the focusing action of the lens whilst energised by the first set of voltages will act upon the ions of interest and fewer of the other, unwanted ions in the beam. The action of the lens whilst energised by the second set of voltages will act upon a greater proportion of the other, unwanted ions in the beam. This process continues as the beam continues to fly through the analyser, and whilst the ions of interest progressively receive arcuate focusing, summing to a first magnitude of arcuate focusing, the other unwanted ions within the beam receive arcuate focusing summing to a second magnitude of arcuate focusing, the second magnitude of arcuate focusing being smaller than the first magnitude of arcuate focusing.

Alternatively, the beam may not undergo any arcuate focusing within the analyser until the ions have separated out along the flight path according to their mass to charge ratio sufficiently so that the action of the one or more sets of electrodes adjacent the main flight path whilst the first set of voltages is applied to them is such that largely only the ions of interest undergo substantial arcuate focusing. Accordingly, the one or more sets of electrodes adjacent the main flight path may not be energised with the first set of voltages until the beam of ions has passed in the vicinity of the one or more sets of electrodes adjacent the main flight path a number of times.

The one set of voltages may be applied to some of the one or more sets of electrodes adjacent the main flight path whilst the ions of interest are in the vicinity of any of the said some of the one or more sets of electrodes adjacent the main flight path, and the one or more different sets of voltages may be applied to different one or more sets of electrodes adjacent the main flight path when ions of interest are not in the vicinity of any of said different one or more sets of electrodes adjacent the main flight path.

Alternatively the one set of voltages (voltage set A) may be applied to some of the one or more sets of electrodes adjacent the main flight path (electrode set A) whilst the ions of interest are in the vicinity of any of electrode set A, and the one or more different sets of voltages may be applied to the same one or more sets of electrodes adjacent the main flight path (electrode set A) and also to additional one or more sets of electrodes adjacent the main flight path (electrode set B) when ions of interest are not in the vicinity of any of electrode set B. For example, the one or more different sets of voltages may comprise the voltage set A when applied to electrode set A, and may further comprise additional voltages applied to the electrode set B. This has the effect that electrode set A have the same voltages applied to them at all times, to provide arcuate focusing at all times to any ions in the vicinity of any of electrode set A, whilst electrode set B have different one or more sets of voltages applied, to provide beam deflection when the ions of interest are not adjacent any of electrode set B.

The first set of voltages applied to the one or more of the sets of electrodes adjacent the main flight path cause the one or more sets of electrodes adjacent the main flight path to be activated so as to provide a focusing action upon any ions passing sufficiently close to the to one or more sets of electrodes adjacent the main flight path. The sets of electrodes adjacent the main flight path (which will be further described) thus function by the application of electrical potentials, by creating electrical fields which affect the trajectories of charged particles that pass through those electrical fields. Hence the first set of voltages applied to the one or more of the sets of electrodes adjacent the main flight path cause the one or more sets of electrodes adjacent the main flight path to be activated so as to provide a focusing action upon any ions passing through the electrical fields produced by the one or more sets of electrodes adjacent the main flight path. The second set of voltages cause the one or more sets of electrodes adjacent the main flight path to be at least partly de-activated so as to fail to provide the same degree of focusing action upon any ions passing through the electrical fields produced by the one or more sets of electrodes adjacent the main flight path as was produced when the one or more sets of electrodes adjacent the main flight path had the first set of voltages applied. Preferably the second set of voltages produces a defocusing or disrupting action upon any ions passing through the electrical fields produced by the one or more sets of electrodes adjacent the main flight path so as to deflect and eject those ions from main flight path. In this way the first set of voltages produces a focusing effect upon the ions of interest and the ions of interest have their divergences constrained and the ions of interest are retained upon the main flight path and the second set of voltages produces little or no focusing effect and a disrupting or deflecting action upon the unwanted ions so as to cause them to leave the main flight path. In this way the method of the present invention is used to select ions of interest from a beam of ions using an analyser.

Preferably the second set of voltages is applied to the one or more arcuate lenses whilst the ions of interest are distant from the one or more arcuate lenses, so that the change in the electric field does not influence the ions of interest. In a preferred embodiment where there is a single arcuate focusing lens, conveniently the second set of voltages may be switched on when the ions of interest are shielded from the arcuate focusing lens by one or more inner field defining electrode structures or by other structures within the analyser.

The first and second set of voltages may or may not be the only set of voltages applied to the one or more sets of electrodes adjacent the main flight path.

Optionally a third set of voltages may be applied to the one or more sets of electrodes adjacent the main flight path at various times, the third set of voltages being such as to neither induce arcuate focusing, nor to induce beam deflection. Further optionally, a fourth and higher set(s) of voltages, may be applied.

Ions of one or more ranges of m/z may be selected from the same beam of ions using the method of the present invention, i.e. the ions of interest may comprise a plurality of ranges of m/z.

The beam of ions may pass in the vicinity of an arcuate focusing lens at regular or irregular intervals. Preferably the beam of ions passes in the vicinity of an arcuate focusing lens at regular intervals. Preferably, the one set of voltages applied to the one or more of the sets of electrodes adjacent the main flight path constrains the arcuate divergence of the ions of interest and is applied after every i-th reflection in one or both of the mirrors, wherein i is an integer number. More preferably the beam of ions passes in the vicinity of an arcuate focusing lens once per reflection.

In preferred embodiments in which there are two sets of electrodes (i.e. two lenses) adjacent the main flight path on opposite sides of the analyser (opposite sides of the z axis), located on a line passing through the z axis (perpendicular to the z axis), preferably the ions undergo $n*\pi$ angular rotations of the analyser per reflection, where n is an odd integer. In other preferred embodiments in which there is a single arcuate focusing lens, preferably the ions undergo $N*\pi$ angular rotations of the analyser per reflection, where N is an even integer.

Preferably the one or more sets of electrodes adjacent the main flight path are used both to constrain the arcuate beam divergence of the ions of interest and to provide beam deflection to unwanted ions so as to deflect the unwanted ions off the main flight path. However in some embodiments different electrodes may be used for these two operations. This may be accomplished by applying the first set of voltages to some sets of electrodes adjacent the main flight path (a first set of electrodes) and the second set of voltages to other sets of electrodes adjacent the main flight path (a second set of electrodes). Both the first set of electrodes and the second set of electrodes may be of similar structure, or they may be of differing structure from each other. Preferably the first set of electrodes and the second set of electrodes are of similar structure to each other for ease of manufacture.

The two opposing mirrors may be the same or they may be different. Preferably the two opposing mirrors are the same.

In reference to the two opposing mirrors, by the term opposing electrical fields (optionally the electrical fields being substantially linear along z) is meant a pair of charged particle mirrors each of which reflects charged particles towards the other by utilising an electric field, those electric fields preferably being substantially linear in at least the longitudinal (z) direction of the analyser, i.e. the electric field has a linear dependence on distance in at least the longitudinal (z) direction, the electric field increasing substantially linearly with distance into each mirror. If a first mirror is elongated along a positive direction of the z axis, and a second mirror is elongated along a negative direction of the z axis, the mirrors preferably abutting at or near the plane $z=0$, the electric field within the first mirror preferably increases linearly with distance into the first mirror in a positive z direction and the electric field within the second mirror preferably increases linearly with distance into the second mirror in a negative z direction. Thus, the opposing electrical fields of the opposing mirrors are oriented in opposite directions. These fields are generated by the application of potentials (electrical bias) to the field-defining electrode systems of the mirrors, which preferably create parabolic potential distributions within each mirror. The opposing electric fields together form an analyser field. The analyser field is thus the electric field within the analyser volume between the inner and outer field-defining electrode systems, which is created by the application of potentials to the field-defining electrode systems of the mirrors. The analyser field is described in more detail below. The electric field within each mirror may be substantially linear along z within only a portion of each mirror. Preferably the electric field within each mirror is substantially linear along z within the whole of each mirror. The opposing mirrors may be spaced apart from one another by a region in which the electric field is not linear along z. In some preferred embodiments there may be a located in this region, i.e. where the electric field is not linear along z, one or more belt electrode assemblies as further described herein. Preferably any such region is shorter in length along z than ⅓ of the distance between the maximum turning points of the charged particle beam within the two mirrors. Preferably, the charged particles fly in the analyser volume with a constant velocity along z for less than half of the overall time of their oscillation, the time of oscillation being the time it takes for the particles to reach the same point along z after reflecting once from each mirror.

Preferably the opposing mirrors abut directly so as to be joined at or near the plane $z=0$. Within the analyser there may be additional electrodes serving further functions, examples of which will be described below, for instance belt electrode assemblies. Such additional electrodes may be within one or both of the opposing mirrors.

In preferred embodiments, the opposing mirrors are substantially symmetrical about the z=0 plane. In other embodiments, the opposing mirrors may not be symmetrical about the z=0 plane. Each mirror comprises inner and outer field-defining electrode systems elongated along a respective mirror axis, the outer system surrounding the inner, each system comprising one or more electrodes. In operation, the charged particles in the beam orbit around the respective mirror axis within each respective mirror, or oscillate between one or more electrodes of the inner field defining electrode system whilst travelling within each respective mirror, travelling within the analyser volume between the inner and outer field-defining electrode systems as they do so. In some embodiments the orbital motion of the beam is a helical motion orbiting around the analyser axis z whilst travelling from one mirror to the other in a direction parallel to the z axis. The orbital motion around the analyser axis z is in some embodiments substantially circular, whilst in other embodiments it is elliptical or of a different shape. The orbital motion around the analyser axis z may vary according to the distance from the z=0 plane.

The mirror axes are generally aligned with the analyser axis z. The mirror axes may be aligned with each other, or a degree of misalignment may be introduced. The misalignment may take the form of a displacement between the axes of the mirrors, the axes being parallel, or it may take the form of an angular rotation of one of the mirror axes with respect to the other, or both displacement and rotation. Preferably the mirrors axes are substantially aligned along the same longitudinal axis and preferably this longitudinal axis is substantially co-axial with the analyser axis. Preferably the mirror axes are co-axial with the analyser axis z.

The field-defining electrode systems may be a variety of shapes as will be further described below. Preferably the field-defining electrode systems are of shapes that produce a quadro-logarithmic potential distribution within the mirrors; but other potential distributions are contemplated and will be further described.

The inner and outer field-defining electrode systems of a mirror may be of different shapes. Preferably the inner and outer field-defining electrode systems are of a related shape, as will be further described. More preferably both the inner and outer field-defining electrode systems of each mirror each have a circular transverse cross section (i.e. transverse to the analyser axis z). However, the inner and outer field-defining electrode systems may have other cross sections than circular such as elliptical, hyperbolic as well as others. The inner and outer field-defining electrode systems may or may not be concentric. In some preferred embodiments the inner and outer field-defining electrode systems are concentric. The inner and outer field-defining electrode systems of both mirrors are preferably substantially rotationally symmetric about the analyser axis.

One of the mirrors may be of a different form to the other mirror, in one or more of: the form of its construction, its shape, its dimensions, the matching of the forms of the shapes between inner and outer electrode systems, the concentricity between the inner and outer electrode systems, the electrical potentials applied to the inner and/or outer field-defining electrode systems or other ways. Where the mirrors are of a different form to each other the mirrors may produce opposing electrical fields which are different to each other. In some embodiments whilst the mirrors are of different construction and/or have different electrical potentials applied to the field-defining electrode systems, the electric fields produced within the two mirrors are substantially the same. In some embodiments the mirrors are substantially identical and have a first set of one or more electrical potentials applied to the inner field-defining electrode systems of both mirrors and a second set of one or more electrical potentials applied to the outer field-defining electrode systems of both mirrors. In other embodiments the mirrors differ in prescribed ways, or have differing potentials applied, in order to create asymmetry (i.e. different opposing electrical fields), which provides additional advantages.

A field-defining electrode system of a mirror may consist of a single electrode, for example as described in U.S. Pat. No. 5,886,346, or a plurality of electrodes (e.g. a few or many electrodes), for example as described in WO 2007/000587. The inner electrode system of either or both mirrors may for example be a single electrode, as may the outer electrode system. Alternatively a plurality of electrodes may be used to form the inner and/or outer electrode systems of either or both mirrors. Preferably the field-defining electrode systems of a mirror consist of single electrodes for each of the inner and outer electrode systems. The surfaces of the single electrodes will constitute equipotential surfaces of the electrical fields.

The outer field-defining electrode system of each mirror is of greater size than the inner field-defining electrode system and is located around the inner field-defining electrode system. As in the Orbitrap™ electrostatic trap, the inner field-defining electrode system is preferably of spindle-like form, more preferably with an increasing diameter towards the mid-point between the mirrors (i.e. towards the equator (or z=0 plane) of the analyser), and the outer field-defining electrode system is preferably of barrel-like form, more preferably with an increasing diameter towards the mid-point between the mirrors, (the Orbitrap™ electrostatic trap is described, for example, in U.S. Pat. No. 5,886,346). This preferred form of analyser construction advantageously uses fewer electrodes and forms an electric field having a higher degree of linearity than many other forms of construction. In particular, forming parabolic potential distributions in the direction of the mirror axes within the mirrors with the use of electrodes shaped to match the parabolic potential near the axial extremes produces a desired linear electric field to higher precision near the locations at which the charged particles reach their turning points and are travelling most slowly. Greater field accuracy at these regions provides a higher degree of time focusing, allowing higher mass RP to be obtained. Where the inner field defining electrode system of a mirror comprises a plurality of electrodes, the plurality of electrodes is preferably operable to mimic a single electrode of spindle-like form. Similarly, where the outer field defining electrode system of a mirror comprises a plurality of electrodes, the plurality of electrodes is preferably operable to mimic a single electrode of barrel-like form.

The inner field-defining electrode systems of each mirror are preferably of increasing diameter towards the mid-point between the mirrors (i.e. towards the equator (or z=0 plane) of the analyser. The inner field-defining electrode systems of each mirror may be separate electrode systems from each other separated by an electrically insulating gap or, alternatively, a single inner field-defining electrode system may constitute the inner field-defining electrode systems of both mirrors (e.g. as in the Orbitrap™ electrostatic trap). The single inner field-defining electrode system may be a single piece inner field-defining electrode system or two inner field-defining electrode systems in electrical contact. The single inner field-defining electrode system is preferably of spindle-like form, more preferably with an increasing diameter towards the mid-point between the mirrors. Similarly, the outer field-defining electrode systems of each mirror are preferably of increasing diameter towards the mid-point between the mirrors. The outer field-defining electrode systems of each mirror may be separate electrodes from each other separated by an electrically insulating gap or, alternatively, a single outer field-defining electrode system may constitute the outer field-defining electrode systems of both mirrors. The single outer field-defining electrode system may be a single piece outer electrode or two outer electrodes in electrical contact. The single outer field-defining electrode system is preferably of barrel-like form, more preferably with an increasing diameter towards the mid-point between the mirrors.

Preferably, the two mirrors abut near, more preferably at, the z=0 plane to define a continuous equipotential surface. The term abut in this context does not necessarily mean that the mirrors physically touch but means they touch or lie closely adjacent to each other. Accordingly, in some preferred embodiments the charged particles preferably undergo simple harmonic motion in the longitudinal direction of the analyser which is perfect or near perfect.

In one embodiment, a quadro-logarithmic potential distribution is created within the analyser. The quadro-logarithmic potential is preferably generated by electrically biasing the two field-defining electrode systems. The inner and outer field-defining electrode systems are preferably shaped such that when they are electrically biased a quadro-logarithmic potential is generated between them. The total potential distribution within each mirror is preferably a quadro-logarithmic potential, wherein the potential has a quadratic (i.e. parabolic) dependence on distance in the direction of the analyser axis z (which is the longitudinal axis) and has a logarithmic dependence on distance in the radial (r) direction. In other embodiments, the shapes of the field-defining electrode systems are such that no logarithmic potential term is generated in the radial direction and other mathematical forms describe the radial potential distribution.

As used herein, the terms radial, radially refer to the cylindrical coordinate r. In some embodiments, the field-defining electrode systems of the analyser and/or the main flight path within the analyser do not posses cylindrical symmetry, as for example when the cross sectional profile in a plane at constant z is an ellipse, and the terms radial, radially if used in conjunction with such embodiments do not imply a limitation to only cylindrically symmetric geometries.

In some embodiments the analyser electrical field is not necessarily linear in the direction of the analyser axis z but in preferred embodiments is linear along at least a portion of the length along z of the analyser volume.

All embodiments of the present invention have several advantages over many prior art multi-reflecting systems. The presence of one or more inner field-defining electrode systems serves to shield charged particles on one side of the system from the charge present on particles on the other side, reducing the effects of space charge on the train of packets. More than this, by choosing an appropriate geometry (as described for example in A. Makarov, E. Denisov, O. Lange, "Performance evaluation of a high-field Orbitrap mass analyzer". J. Am. Soc. Mass Spectrom. 2009, 20, 1391-1396) image charges induced by ions on the inner electrodes could compensate image charges induced on the outer electrodes as well as space charge repulsion within the beam so that any net change of oscillation frequency becomes negligible. In addition, axial spreading of the beam (i.e. spreading in the direction of the analyser axis z) due to any remaining space charge influence does not change significantly the time of flight of the particles in an axial direction—the direction of time of flight separation.

In preferred embodiments utilising opposing linear electric fields in the direction of the analyser axis, the charged particles are at all times whilst upon the main flight path travelling with speeds which are not close to zero and which are a substantial fraction of the maximum speed. In such embodiments, the charged particles are also never sharply focused except in some embodiments where they are focused only upon commencing the main flight path. Both these features thereby further reduce the effects of space charge upon the beam. The undesirable effect of self-bunching of charged particles may also be avoided by the introduction of very small field non-linearities, as described in WO06129109.

In preferred embodiments, the invention utilises a quadro-logarithmic potential concentric electrode structure as used in an Orbitrap™ electrostatic trap, in the form of a TOF separator. In principle, both perfect angular and energy time focusing is achieved by such a structure.

An additional fundamental problem with prior art folded path reflecting arrangements utilising parabolic potential reflectors is that the parabolic potential reflectors cannot be abutted directly to one another without distorting the linear field of the reflectors to some extent, which has generally led to the introduction of a relatively long portion of relatively field free drift space between the reflectors. Furthermore, in the prior art the use of linear fields (parabolic potentials) in reflectors leads to the charged particles being unstable in a perpendicular direction to their travel. To compensate for this the prior art has used a combination of a field free region, a strong lens and a uniform field. Either the distortion and/or the presence of field free regions makes perfect harmonic motion impossible with such prior art parabolic potential reflectors. To obtain a high degree of time focusing at the detector, the field within one or more of the reflectors must be changed to try and compensate for this, or some additional ion optical component must be introduced into the flight path. In contrast to the mirrors of some embodiments of the present invention, perfect angular and energy focusing cannot be achieved with these multi-reflection arrangements.

A preferred quadro-logarithmic potential distribution U(r, z) formed in each mirror is described in equation (1):

$$U(r,z) = \frac{k}{2}\left(z^2 - \frac{r^2}{2}\right) + \frac{k}{2}(R_m)^2 \ln\left[\frac{r}{R_m}\right] + C \tag{1}$$

where r,z are cylindrical coordinates (r=radial coordinate; z=longitudinal or axial coordinate), C is a constant, k is field linearity coefficient and $R_m$ is the characteristic radius The latter has also a physical meaning: the radial force is directed towards the analyser axis for $r<R_m$, and away from it for $r>R_m$, while at $r=R_m$ it equals 0. Radial force is directed towards the axis at $r<R_m$. In preferred embodiments $R_m$ is at a greater radius than the outer field-defining electrode systems of the mirrors, so that charged particles travelling in the space between the inner and outer field-defining electrode systems always experience an inward radial force, towards the inner field-defining electrode systems. This inward force balances the centripetal force of the orbiting particles.

When ions are moving on circular spiral of radius R in such a potential distribution, their motion could be described by three characteristic frequencies of oscillation of charged particles in the potential of equation (1): axial oscillation in the z direction given in equations (2) by ω, orbital frequency of oscillation (hereinafter termed angular oscillation) around the inner field-defining electrode system in what is herein termed the arcuate direction ($\phi$) given in equations (2) by $\omega_\phi$ and radial oscillation in the r direction given in equations (2) by $\omega_r$.

$$\omega = \sqrt{\frac{e}{\left(\frac{m}{z}\right)} \cdot k} \tag{2}$$

$$\omega_\phi = \omega \cdot \sqrt{\frac{\left(\frac{R_m}{R}\right)^2 - 1}{2}}$$

$$\omega_r = \omega \cdot \sqrt{\left(\frac{R_m}{R}\right)^2 - 2}$$

where e is the elementary charge, m is the mass and z is the charge of the charged particles, and R is the initial radius of the charged particles. The radial motion is stable if $R<R_m/2^{1/2}$ therefore $\omega_\phi>\omega/2^{1/2}$, and for each reflection (i.e. change of axial oscillation phase by $\pi$), the trajectory must rotate by more than $\pi/(2)^{1/2}$ radian. A similar limitation is present for potential distributions deviating from (1) and represents a significant difference from all other types of known ion mirrors.

The equations (2) show that the axial oscillation frequency is independent of initial position and energy and that both rotational and radial oscillation frequencies are dependent on initial radius, R. Further description of the characteristics of this type of quadro-logarithmic potential are given by, for example, A. Makarov, Anal. Chem. 2000, 72, 1156-1162.

Whilst a preferred embodiment utilises a potential distribution as defined by equation (1), other embodiments of the present invention need not. Embodiments utilising the opposing linear electric fields in the direction of the analyser (longitudinal) axis can use any of the general forms described by equations (3a) and (3b) in (x,y) coordinates, the equations also given in WO06129109.

$$U_g(x, y, z) = U(r, z) + W(x, y) \tag{3a}$$

$$W(x, y) = -\frac{k}{4}[x^2 - y^2]a + \left[A \cdot r^m + \frac{B}{r^m}\right]\cos\left\{m \cdot \cos^{-1}\left(\frac{x}{r}\right) + \alpha\right\} + b \cdot \ln\left(\frac{r}{D}\right) + E \cdot \exp(F \cdot x)\cos(F \cdot y + \beta) + G\exp(H \cdot y)\cos(H \cdot x + \gamma) \tag{3b}$$

where $r=\sqrt{(x^2+y^2)}$, $\alpha$, $\beta$, $\gamma$, a, A, B, D, E, F, G, H are arbitrary constants (D>0), and j is an integer. Equations (3a) and (3b) are general enough to remove completely any or all of the terms in Equation (1) that depend upon r, and replace them with other terms, including expressions in other coordinate systems (such as elliptic, hyperbolic, etc.). For a particle starting and ending its path at z=0, the time-of-flight in the potential described by equations (3a) and 3(b) corresponds to one half of an axial oscillation:

$$T = \frac{\pi}{\omega} = \pi\sqrt{\frac{(m/z)}{ek}} \tag{4}$$

The coordinate of the turning point is $z_{tp}=v_z/\omega$ where $v_z$ is axial component of velocity at z=0 and equivalent path length over one half of axial oscillation (i.e. single reflection) is $v_z T=\pi z_{tp}$. The equivalent or effective path length is therefore longer than the actual axial path length by a factor $\pi$ and is a measure representative of the path length over which time of flight separation occurs. This enhancement by the factor $\pi$ is due to the deceleration of the charged particles in the axial direction as they penetrate further into each of the mirrors. In the present invention the preferred absence of any significant length of field-free region in the axial direction produces this large enhancement and is an additional advantage over reflecting TOF analysers that utilize extended field-free regions.

The beam of charged particles flies through the analyser along a main flight path. The main flight path preferably comprises a reflected flight path between the two opposing mirrors. The main flight path of the beam between the two opposing mirrors lies in the analyser volume, i.e. between the inner and outer field-defining electrode systems. The two directly opposing mirrors in use define a main flight path for the charged particles to take as they undergo at least one full oscillation of motion in the direction of the analyser (z) axis between the mirrors. As the beam of charged particles flies through the analyser along the main flight path it preferably undergoes at least one full oscillation of substantially simple harmonic motion along the longitudinal (z) axis of the analyser whilst orbiting around the analyser axis (i.e. rotation in the arcuate direction). As used herein, the term angle of orbital motion refers to the angle subtended in the arcuate direction as the orbit progresses. Accordingly, a preferred motion of the beam along its flight path within the analyser is a helical motion around the inner field-defining electrode system.

Additional embodiments of the invention utilise two opposing mirrors with the analyser field generated within the analyser volume by the application of potentials to electrode structures comprising two opposing outer field-defining electrode systems and two opposing inner field-defining electrode systems, wherein the inner field-defining electrode systems comprise a plurality of spindle-like electrode structures extending within the outer field-defining electrode systems. Each of the plurality of spindle-like structures extends substantially parallel to the z axis. In common with previously described embodiments, the field in the z direction is substantially linear and ion motion along the main flight path in the z direction is substantially simple harmonic. Ion motion orthogonal to the z direction may take a variety of forms, including: orbiting around one or more of the inner field-defining electrode spindle structures; and, oscillating between one or more pairs of the inner field-defining electrode spindle structures. The term orbiting around includes orbiting successively around each of a plurality of the inner field-defining electrode spindle structures one or more times and it also includes orbiting around a plurality of the inner field-defining electrode spindle structures in each orbit, i.e. each orbit encompasses more than one of the inner field-defining electrode spindle structures. The term oscillating between includes, (whilst executing substantially harmonic motion in a direction substantially parallel to the z axis), substantially linear motion in a plane perpendicular to the z axis and it also includes motion where such substantially linear motion rotates about the z axis producing a star-shaped beam envelope, which will be further described. The term oscillating between also includes motion where the ions remain approximately the same distance from each of two inner field-defining electrode spindle structures.

The above embodiments are particular solutions to the general equation $$U(x, y, z) = \frac{k}{2} \cdot z^2 + V(x, y) \tag{5a}$$

where k has the same sign as ion charge (e.g. k is positive for positive ions) and $$\Delta V(x, y) = -\frac{k}{2}. \tag{5b}$$

Specifically, solutions include $$U(x, y, z) = \sum_{i=1}^{N} A_i \cdot \ln(f_i(x, y)) + \frac{k}{2} \cdot (z^2 - (1-a) \cdot x^2 - a \cdot y^2) + W(x, y) \tag{6a}$$

where $$W(x, y) = \left(B \cdot r^m + \frac{D}{r^m}\right) \cdot \cos\left(m \cdot \cos^{-1}\left(\frac{x}{r}\right) + \alpha\right) + E \cdot \exp(F \cdot x) \cdot \cos(F \cdot y + \beta) + G \cdot \exp(H \cdot y) \cdot \cos(H \cdot x + \gamma) + C \tag{6b}$$

and where $A_i$, B, C, D, E, F, G, H are real constants and each $f_i(x, y)$ satisfies $$f(x, y) = \frac{\left(\frac{d}{dx}(f(x, y))\right)^2 + \left(\frac{d}{dy}(f(x, y))\right)^2}{\frac{d^2}{dx^2}(f(x, y)) + \frac{d^2}{dy^2}(f(x, y))}. \tag{6c}$$

A particular solution being $$f(x,y) = (x^2+y^2)^2 - 2b^2(x^2-y^2) + b^4 \tag{6d}$$

where b is a constant (C. Köster, Int. J. Mass Spectrom. Volume 287, Issues 1-3, pages 114-118 (2009)).

Equations (6a-c) with the particular solution (6d) are satisfied by two opposing mirrors each mirror comprising inner and outer field-defining electrode systems elongated along an axis z, each system comprising one or more electrodes, the outer system surrounding the inner. The inner field-defining electrode systems each comprise one or more electrodes. The one or more electrodes include spindle-like structures extending substantially parallel to the z axis. Each spindle-like structure may itself comprise one or more electrodes. One of the spindle-like structures may be on the z axis. Additionally or alternatively, two or more of the spindle-like structures may be off the z axis, typically disposed symmetrically about the z axis.

Where there is a plurality of sets of electrodes (the sets of electrodes constituting arcuate focusing lenses) adjacent the main flight path and where those lenses are located at or near the z=0 plane, preferably, the beam position advances at the lens location by a distance in the arcuate direction after a given number of reflections from the mirrors (e.g. one or two reflections). In this way, the beam flies along the main flight path through the analyser back and forth along the analyser axis in a path which steps around the analyser axis (i.e. in the arcuate direction) in the z=0 plane so as to intercept sets of electrodes adjacent the main flight path. The orbiting motion may have a circular, elliptic or other form of cross sectional shape.

In other preferred embodiments, the beam orbits around the inner field-defining electrode system of each mirror and thereby around the analyser axis z once per reflection and intercepts a single arcuate focusing lens.

A characteristic feature of some preferred embodiments is that the main flight path orbits around the inner field-defining electrode system approximately once or more than once whilst performing a single oscillation in the direction of the analyser axis. This has the advantageous effect of separating the charged particle beam around the inner field-defining electrode system, reducing the space charge effects of one part of the beam from another, as described earlier. Another advantage is that the strong effective radial potential enforces strong radial focusing of the beam and hence provides a small radial size of the beam. This in turn increases resolving power of the apparatus due to a smaller relative size of the beam and a smaller change of perturbing potentials across the beam. Preferably the ratio of the frequency of the orbital motion to that of the oscillation frequency in the direction of the longitudinal axis z of the analyser is between 0.71 and 5. More preferably the ratio of the frequency of the orbital motion to that of the oscillation frequency in the direction of the longitudinal axis of the analyser is between (in order of increasing preference) 0.8 and 4.5, 1.2 and 3.5, 1.8 and 2.5. Some preferred ranges therefore include 0.8 to 1.2, 1.8 to 2.2, 2.5 to 3.5 and 3.5 to 4.5. Most stable trajectories (with minimum influence from initial parameters) correspond to first two of these ranges.

As the charged particles travel along the main flight path of the analyser, they are separated according to their mass to charge ratio (m/z). The degree of separation depends upon the flight path length in the direction of the analyser axis z, amongst other things. Having been separated, one or more ranges of m/z (e.g. the ions of interest) may be selected for detection or ejection from the analyser, optionally to a detector or to another device for further processing of the particles. The term a range of m/z includes herein a range so narrow as to include only one resolved species of m/z.

In prior art analysers having potential distributions described by equation (3) and other types of analysers, such as the quadro-logarithmic potential distribution, divergence in r is constrained, and arcuate divergence is not constrained at all. Strong radial focusing is achieved automatically in the quadro-logarithmic potential when ions are moving on trajectories close to a circular helix, but the unconstrained arcuate divergence of the beam would, if unchecked, lead to a problem of complete overlapping of trajectories for ions of the same m/z but different initial parameters. Injected charged particles would, as in the Orbitrap™ analyser, form rings around the inner field-defining electrode system, the rings comprising ions of the same m/z, the rings oscillating in the longitudinal analyser axial direction. In the Orbitrap™ analyser, image current detection of ions within the trap is unaffected. However, for use of such a field for time of flight separation and selection of charged particles, a portion of the beam must be selectively ejected from the device for detection or further processing. Some form of ejection mechanism must be introduced into the beam path to eject the beam from the field to a detector. Any ejection mechanism within the analysing field would have to act upon all the ions in the ring if it were to eject or detect all the charged particles of the same m/z present within the analyser. This task is impractical as the various rings of charged particles having differing m/z oscillate at different frequencies in the longitudinal direction of the analyser, and rings of different m/z may overlap at any given time. Even if the beam is ejected or detected before it forms a set of full rings of different m/z particles, during the flight path the initial packet of charged particles becomes a train of packets, lower m/z particles preceding higher m/z particles.

Packets of charged particles at the front of the train that have diverged arcuately, spreading out around the inner field-defining electrode system, could overlap packets further back in the train. If charged particles are to be separated by their flight time and a subset selected by ejecting them from the analyser to a receiver, the selection process would undesirably select ions having undergone widely differing flight times, as overlapping charged particles from different sections of the train would be ejected. The present invention addresses this problem by introducing arcuate focusing, i.e. focusing of the charged particle packets of desired ions in the arcuate direction so as to constrain their divergence in that direction. The term arcuate is used herein to mean the angular direction around the longitudinal analyser axis z. FIG. 1 shows the respective directions of the analyser axis z, the radial direction r and the arcuate direction ø, which thus can be seen as cylindrical coordinates. Arcuate focusing confines the beam so that the ions of interest remain sufficiently localised in their spread around the analyser axis z (i.e. in the arcuate direction) that they may be ejected successfully. With such arcuate focusing the preferred quadro-logarithmic potential of the present invention can be utilised successfully with large numbers of multiple reflections to give a high mass resolution TOF analyser for m/z selection, optionally having unlimited mass range. Arcuate focusing may also be employed in orbital analysers having other forms of potential distributions.

The term arcuate focusing lens (or simply arcuate lens), which one or more sets of electrodes adjacent the main flight path form, is herein used to describe any device which provides a field that acts upon the charged particles in the arcuate direction, the field acting to reduce beam divergence in the arcuate direction. The term focusing in this context is not meant to imply that any form of beam crossover is necessarily formed, nor that a beam waist is necessarily formed. The lens may act upon the charged particles in other directions as well as the arcuate direction. Preferably the lens acts upon the charged particles in substantially only the arcuate direction. The field provided by the arcuate lens is an electric field. It can be seen therefore, that the arcuate lens may be any device that creates a perturbation to the analyser field that would otherwise exist in the absence of the lens. The lens may include additional electrodes added to the analyser, or it may comprise changes to the shapes of the inner and outer field-defining electrode systems. In one embodiment the lens comprises locally-modified inner field-defining electrode systems of one or both of the mirrors, e.g. an inner field-defining electrode system with a locally-modified surface profile. In a preferred embodiment the lens comprises a pair of opposed electrodes, one either side of the main flight path at different radial distance from the analyser axis z. The pair of opposed electrodes may be constructed having various shapes, e.g. substantially circular in shape. In some embodiments comprising a plurality of sets of electrodes adjacent the main flight path, neighbouring electrodes may be merged into a single-piece lens electrode assembly which is opposed by another single-piece lens electrode assembly located at a different distance from the analyser axis on the other side of the beam. That is, a pair of single-piece lens electrode assemblies may be utilised which are shaped to provided a plurality of lenses. A plurality of lenses are thus provided by a single-piece lens electrode assembly which is opposed by another single-piece lens electrode assembly at a different distance from the analyser axis, the single-piece lens electrode assemblies being shaped to provide a plurality of arcuate focusing lenses. The single-piece lens electrode assemblies preferably have edges comprising a plurality of smooth arc shapes. The single-piece lens electrode assemblies preferably extend at least partially, more preferably substantially, around the z axis in the arcuate direction.

The one or more arcuate lenses are located in the analyser volume. The analyser volume is the volume between the inner and outer field-defining electrode systems of the two mirrors. The analyser volume does not extend to any volume within the inner field-defining electrode systems, or to any volume outside the inner surface of the outer field-defining electrode systems.

The one or more arcuate lenses may be located anywhere within the analyser upon or near the main flight path such that in operation the one or more lenses act upon the charged particles as they pass. In preferred embodiments the one or more arcuate lenses are located at approximately the mid-point between the two mirrors (i.e. mid-point along the analyser axis z). The mid-point between the two mirrors along the z axis of the analyser, i.e. the point of minimum absolute field strength in the direction of the z axis, is herein termed the equator or equatorial position of the analyser. The equator is then also the location of the z=0 plane. In another embodiment the one or more arcuate lenses are placed adjacent one or both of the maximum turning points of the mirrors (i.e. the points of maximum travel along z). In more preferred embodiments, the one or more arcuate lenses are located offset from the mid-point between the two mirrors (i.e. mid-point along the analyser axis z) but still near the mid-point as described in more detail below.

The one or more arcuate lenses act upon the charged particles as they travel along the main flight path between the inner and outer field-defining electrode systems.

The one or more arcuate lenses may be supported upon the inner and/or outer field-defining electrode systems, upon additional supports, or upon a combination of the two.

The arcuate focusing is preferably performed on the beam at intervals along the flight path. The intervals may be regular (i.e. periodic) or irregular.

The arcuate focusing is more preferably periodic arcuate focusing. In other words, the arcuate focusing is more preferably performed on the beam at regular arcuate positions along the flight path.

The arcuate focusing is preferably achieved by one or more lenses which preferably are placed within the analyser volume between the inner and outer field-defining electrode systems, i.e. which generate the, e.g. quadro-logarithmic, potentials, i.e. centred on or close to the z=0 plane. Where there is more than one lens, the plurality of lenses may extend completely around the analyser axis z or may extend partially around the analyser axis. In embodiments in which the mirrors are substantially concentric with the analyser axis, the one or more lenses are preferably also substantially concentric with the analyser axis. More preferably, the one or more lenses are each centred on or near the z=0 plane. This is because at this plane the axial force on the particles is zero, the z component of the electric field being zero, and in some preferred embodiments the presence of any lenses least disturbs the parabolic potential in the z direction elsewhere in the analyser, introducing fewest aberrations to the time focusing.

In another embodiment the one or more lenses may be located close to one or both of the turning points within the analyser. In this case whilst the z component of the electric field is at its highest value on the flight path, the charged particles are travelling with the least kinetic energy on the flight path and lower focusing potentials are required to be applied to the arcuate lenses to achieve the desired constrainment of arcuate divergence.

Preferably, where there is more than one arcuate focusing lens, the arcuate focusing lenses are periodically placed around the analyser axis, i.e. regularly spaced around the analyser axis, in the arcuate direction, i.e. as an array of arcuate focusing lenses. Preferably, the arcuate focusing lenses in the array are located at substantially the same z coordinate. The array of arcuate focusing lenses preferably extends around the z axis in the arcuate direction. As described above, near the equator (or near z=0 plane) the beam position preferably advances by an angle or distance in the arcuate direction after a given number of reflections (e.g. one or two reflections) from the mirrors (one full oscillation along z comprises two reflections). The arcuate focusing lenses are preferably periodically placed around the analyser axis of the analyser and spaced apart in the arcuate direction by a distance substantially equal to the distance in the arcuate direction that the beam advances after the given number of reflections from the parabolic mirrors. Furthermore, the arcuate focusing lenses are preferably periodically placed around the analyser axis of the analyser at or near the positions where the beam crosses the equator as it flies through the analyser. In some preferred types of embodiment the plurality of arcuate focusing lenses form an array of arcuate focusing lenses located at substantially the same z coordinate, which more preferably is at or near z=0 but most preferably is offset from (but near) z=0. The offset z coordinate is preferably where the main flight path crosses over itself during an oscillation, which offset z coordinate is near the z=0 plane. The latter arrangement has the advantage that each arcuate focusing lens can be used to focus the beam twice, i.e. after reflection from one mirror and then after the next reflection from the other mirror as described in more detail below. Utilising each lens twice can therefore be achieved using identical mirrors by offsetting the location of the arcuate focusing lenses from the z=0 plane to the z coordinate where the main flight path crosses over itself during an oscillation. The lenses are thus preferably spaced apart in the arcuate direction by the distance that the beam advances in the arcuate direction at the z coordinate at which the lenses are placed after each oscillation along z.

Unlike other multi-reflection or multi-deflection TOFs, there is substantially no field-free drift space (most preferably no field-free drift space) at all as the arcuate lenses are integrated within the analyser field produced by the opposing mirrors, and at no point does the electric analyser field approach zero. Even where there is no axial field, there is a field in the radial direction present. In addition, the charged particles turn about the analyser axis, and/or about one or more of the inner field-defining electrode systems per each reflection by an angle which is typically much higher (up to tens of times) than the periodicity of the arcuate lenses. In the analyser of the invention, a substantial axial field (i.e. the field in the z direction) is present throughout the majority of the axial length (preferably two thirds or more) of the analyser. More preferably, a substantial axial field is present throughout 80% or more, even more preferably 90% or more, of the axial length of the analyser. The term substantial axial field herein means more than 1%, preferably more than 5% and more preferably more than 10% of the strength of the axial field at the maximum turning point in the analyser.

In preferred embodiments utilising the quadro logarithmic potential described by equation (1), at the z=0 plane the potential in the radial direction (r) can be approximated by the potential between a pair of concentric cylinders. For this reason, in one type of preferred embodiment, one or more belt electrode assemblies are used, e.g. to support the one or more arcuate focusing lenses or to help to shield the main flight path from voltages applied to other electronic components (e.g. arcuate lens electrodes, accelerators, deflectors, detectors etc.) which may be located within the analyser volume between the inner and outer field-defining electrode systems or for other purposes. A belt electrode assembly herein is preferably a belt-shaped electrode assembly located in the analyser volume although it need not extend completely around the inner field-defining electrode systems of the one or both mirrors, i.e. it need not extend completely around the z axis. Thus, a belt electrode assembly extends at least partially around the inner field-defining electrode systems of the one or both mirrors, i.e. at least partially around the z axis, more preferably substantially around the z axis. The belt electrode assembly preferably extends in an arcuate direction around the z axis. The one or more belt electrode assemblies may be concentric with the analyser axis. The one or more belt electrode assemblies may be concentric with the inner and outer field-defining electrode systems of one or both mirrors. In a preferred embodiment the one or more belt electrode assemblies are concentric with both the analyser axis, z, and the inner and outer field-defining electrode systems of both mirrors. In some embodiments, the one or more belt electrode assemblies comprise annular belts located between the inner and outer field-defining electrode systems of one or both mirrors, at or near the z=0 plane. In other embodiments, a belt electrode assembly may take the form of a ring located near the maximum turning point of the charged particle beam within one of the mirrors. In some embodiments, it may not be necessary for the belt electrode assemblies to extend completely around the inner field-defining electrode systems of the one or both mirrors, e.g. where there are a small number of arcuate focusing lenses, e.g. one or two arcuate focusing lenses. In use, the belt electrode assemblies function as electrodes to approximate the analyser field (e.g. quadro-logarithmic field), preferably in the vicinity of the z=0 plane, and have a suitable potential applied to them. The presence of belt electrode assemblies may distort the electric field near the z=0 plane. Use of belt electrode assemblies having profiles to follow the equipotential field lines within the analyser (e.g. quadro-logarithmic shapes in analysers of having quadro-logarithmic potential distributions) would remove this field distortion near the z=0 plane. However the presence of any energized arcuate lens or deflection electrodes situated upon the belt electrode assemblies would also distort the electrical field along z to some extent in the region of the belt electrode assemblies.

The one or more belt electrode assemblies may be supported and spaced apart from the inner and/or outer field-defining electrode systems, e.g. by means of electrically insulating supports (i.e. such that the belt electrode assemblies are electrically insulated from the inner and/or outer field-defining electrode systems). The electrically insulating supports may comprise additional conductive elements appropriately electrically biased in order to approximate the potential in the region around them. The outer field-defining electrode system of one or both mirrors may be waisted-in at and/or near the z=0 plane to support the outer belt electrode assembly.

The belt electrode assemblies are electrically insulated from the arcuate focusing lenses which they may support. Preferably, the belt electrode assemblies extend beyond the edges of the arcuate focusing lenses in the z direction in order to shield the remainder of the analyser from the potentials applied to the lenses.

The one or more belt electrode assemblies may be of any suitable shape, e.g. the belts may be in the form of cylinders, preferably concentric cylinders. Preferably, the belt electrode assemblies are in the form of concentric cylinder electrodes.

More preferably, the one or more belt electrode assemblies may be in the form of sections having a shape which substantially follows or approximates the equipotentials of the analyser field at the place the belt electrode assemblies are located. As a more preferred example, the belt electrode assemblies may be in the form of quadro-logarithmic sections, i.e. their shape may follow or approximate the equipotentials of the quadro-logarithmic field (i.e. the undistorted quadro-logarithmic field) at the place the belt electrode assemblies are located. The belt electrode assemblies may be of any length in the longitudinal (z) direction, but preferably where the belt electrode assemblies only approximate the quadro-logarithmic potential in the region in which they are placed, such as when they are, for example, cylindrical in shape, they are less than ⅓ the length of the distance between the turning points of the main flight path in the two opposing mirrors. More preferably where the belt electrode assemblies are cylindrical in shape, they are less than ⅙ the length of the distance between the turning points of the main flight path in the two opposing mirrors in the longitudinal (z) direction.

In some embodiments, there may be used only one belt electrode assembly, e.g. where one sub-set (i.e. on one side of the main flight path) of arcuate lenses can be supported by one belt electrode assembly and the other sub-set of lenses are also supported by the inner or outer field-defining electrode system. In other embodiments, there may be used two or more belt electrode assemblies, e.g. where the arcuate lenses require support by two belt electrode assemblies. In the case of using two or more belt electrode assemblies the belt electrode assemblies may comprise at least an inner belt electrode assembly and an outer belt electrode assembly, the inner belt electrode assembly lying closest to the inner field-defining electrode system and the outer belt electrode assembly having greater diameter than the inner belt electrode assembly and lying outside of the inner belt electrode assembly. At least one belt electrode assembly (the outer belt electrode assembly) may be located outside (i.e. at larger distance from the analyser axis) of the flight path of the beam and/or at least one belt electrode assembly (the inner belt electrode assembly) may be located inside (i.e. at a smaller distance from the analyser axis) of the flight path of the beam. Preferably, there are at least two belt electrode assemblies preferably placed within the analyser between the outer and inner field-defining electrode systems, with a belt electrode assembly either side of the flight path (i.e. at different radiuses). In some embodiments the inner and outer field-defining electrode systems do not have a circular cross section in the plane z=constant. In these cases preferably the one or more belt electrode assemblies also do not have a circular cross section in the plane z=constant, but have a cross sectional shape to match those of the inner and outer field-defining electrode systems.

The belt electrode assemblies may, for example, be made of conductive material or may comprise a printed circuit board having conductive lines thereon. Other designs may be envisaged. Any insulating materials, such as printed circuit board materials, used in the construction of the analyser may be coated with an anti-static coating to resist build-up of charge.

In some preferred embodiments, the one or more arcuate focusing lenses may be supported by the surface of one, or more preferably both, of the inner and outer field defining electrode systems, i.e. without need for belt electrode assemblies. In such cases, the arcuate focusing lenses will of course be electrically insulated from the field defining electrode systems. In such cases, the surface of the arcuate focusing lenses facing the beam may be flush with the surface of the field defining electrode system which they are supported by.

It is preferred that every time the beam crosses the z=0 plane it passes through an arcuate focusing lens to achieve an optimum reduction of beam spreading in the arcuate direction, where the arcuate focusing lens is preferably located either at or near to where the beam crosses the z=0 (i.e. the arcuate focusing lens may be offset slightly from the z=0 plane as in some preferred embodiments described herein). This therefore does not mean that that the beam necessarily passes through an arcuate lens actually on the z=0 plane each time the beam passes the z=0 plane but the lens may instead be offset from the z=0 but is passed through for each pass through z=0. In this context, every time the beam crosses the z=0 plane may exclude the first time it crosses the z=0 plane (i.e. close to an injection point) and may exclude the last time it crosses the z=0 plane (i.e. close to an ejection or detection point). However, it is possible that the beam does not pass through an arcuate focusing lens every time it crosses the z=0 plane and instead passes through an arcuate focusing lens a fewer number times it crosses the z=0 plane (e.g. every second time it crosses the z=0 plane). Accordingly, any number of arcuate focusing lenses is envisaged.

Any suitable type of lens capable of focusing in the arcuate direction may be utilised for the arcuate focusing lens(es). Various types of arcuate focusing lens are further described below.

One preferred embodiment of arcuate focusing lens comprises a pair of opposing lens electrodes (preferably circular or smooth arc shaped lens electrodes, i.e. having smooth arc shaped edges). The opposing lens electrodes may be of substantially the same size or different size e.g. of sizes scaled to the distance from the analyser axis at which each lens electrode is located. The opposing lens electrodes have potentials applied to them that differ from the potentials that would be in the vicinity of the lens electrodes otherwise (i.e. if the lens electrodes were not there). In preferred embodiments opposing lens electrodes have different potentials applied and the beam of charged particles passes between the pair of opposing lens electrodes which when biased focus the beam in an arcuate direction across the beam, where the lens electrodes are opposing each other in a radial direction across the beam. Where the lenses are supported in belt electrode assemblies as described above, preferably the opposing lens electrodes follow the contour of the belt electrode assembly in which they are supported.

The arcuate focusing may be applied to various types of opposing mirror analysers that employ orbital particle motion about an analyser axis, not limited to opposed linear electric fields oriented in the direction of the analyser axis. Preferably the arcuate focusing is performed in an analyser having opposed linear electric fields oriented in the direction of the analyser axis. In a preferred embodiment the arcuate focusing is employed in an analyser utilising a quadro-logarithmic potential.

The two opposing mirrors in use define a main flight path for the charged particles to take. In some preferred embodiments a preferred motion of the beam along its flight path within the analyser is a helical motion around the inner field-defining electrode system. In these cases the beam flies along the main flight path through the analyser back and forth in the direction of the longitudinal axis in a helical path which moves around the longitudinal axis (i.e. in the arcuate direction) in the z=0 plane. In all cases, the main flight path is a stable trajectory that is followed by the charged particles when predominantly under the influence of the main analyser field. In this context, a stable trajectory means a trajectory that the particles would follow indefinitely if uninterrupted (e.g. by deflection), assuming no loss of the beam through energy dissipation by collisions or defocusing. Preferably a stable trajectory is a trajectory followed by the ion beam in such a way that small deviations in initial parameters of ions result in beam spreading that remains small relative to the analyser size over the entire length of the trajectory. In contrast, an unstable trajectory means a trajectory that the particles would not follow indefinitely if uninterrupted, assuming no loss of the beam through energy dissipation by collisions or defocusing. The main flight path accordingly, does not comprise a flight path of progressively decreasing or increasing radius. However the main flight path may comprise a path which oscillates in radius, e.g. an elliptical trajectory when viewed along the analyser axis. The main analyser field is generated when the inner and outer field defining electrode systems of each mirror are given a first set of one or more analyser voltages. The term first set of one or more analyser voltages herein does not mean that the set of voltages is the first to be applied in time (it may or may not be the first in time) but rather it simply denotes that set of voltages which is given to the inner and outer field-defining electrode systems to make the charged particles follow the main flight path. The main flight path is the path on which the particles spend most of their time during their flight through the analyser.

The charged particle beam may enter the analyser volume through an entry aperture in one or both of the outer field-defining electrode systems of the mirrors, or through an aperture in one or both of the inner field-defining electrode systems of the mirrors. The injector is preferably substantially located outside the analyser volume. The injector may accordingly be located outside the outer field-defining electrode systems of the mirrors, or inside the inner field-defining electrode systems of the mirrors. In a preferred embodiment, ions enter the analyser through an entry aperture in a direction perpendicular to the analyser axis z at a turning point within one of the opposing ion mirrors. The preferred direction is perpendicular to the analyser axis z but does not necessarily intersect the analyser axis z, rather it is preferably displaced from the analyser axis z by a radial distance equal to that of the main flight path. The entry aperture may be located in the inner field-defining electrode system of one of the mirrors, or it may be located in the outer field-defining electrode system of one of the mirrors. Preferably the entry aperture is located in the outer field-defining electrode system of one of the mirrors near, more preferably at, the turning point of the ions in that mirror.

Various types of injector can be used with the present invention, including but not limited to pulsed laser desorption, pulsed multipole RF traps using either axial or orthogonal ejection, pulsed Paul traps, electrostatic traps, and orthogonal acceleration. Preferably, the injector comprises a pulsed charged particle source, typically a pulsed ion source, e.g. a pulsed ion source as aforementioned. Preferably the injector provides a packet of ions of width less than 5-20 ns. Most preferably the injector is a curved trap such as a C-trap, for example as described in WO 2008/081334. There is preferably a time of flight focus at the detector surface or other desired surface. To assist achievement of this, preferably the injector has a time focus at the exit of the injector. More preferably the injector has a time focus at the start of the main flight path of the analyser. This could be achieved, for example, by using additional time-focusing optics such as mirrors or electric sectors. Preferably, voltage on one or more belt electrode assemblies is used to finely adjust the position of the time focus. Preferably, voltage on belts is used to finely adjust the position of the time focus.

In some embodiments, preferably the injector is situated such that there is a degree of time of flight separation of ions before entry to the analyser and this may be achieved by, for example, locating the injector at a distance from the analyser. In a preferred embodiment, the beam of ions from the injector is directed through an entry aperture in the outer field defining electrode of one of the mirrors into the analyser volume whilst the analyser field is switched off or is switched to a lower magnitude than the main analyser field, and the analyser field is then switched on to the magnitude of the main analyser field when the ions of interest reach a suitable point such that in the presence of the main analyser field the ions of interest commence upon the main flight path with no further intervention. Herein, the analyser field is the electric field within the analyser volume between the inner and outer field-defining electrode systems of the mirrors, which is created by the application of potentials to the field-defining electrode systems. Herein the main analyser field is the analyser field in which charged particles on the main flight path continue to move along the main flight path.

Where there is a degree of time of flight separation of ions before entry to the analyser, the above method of injection enables ions of a restricted range of m/z to be pre-selected, as only ions within the restricted range which includes the ions of interest will be at the suitable point when the main analyser field is switched on, and hence only ions within the restricted range will commence upon the main flight path. Ions not within the restricted range may be lost, may follow unstable orbits, or may follow stable orbits which are not the main flight path. Accordingly ions not within the restricted range may not be ejected along with the ions of interest and preferably are not ejected along with the ions of interest.

Alternatively, where ions of a plurality of ranges of m/z are to be selected from a beam of ions, and the ranges are of substantially differing average m/z, preferably the injector has a time of flight focus within the analyser, more preferably on the main flight path of the analyser, so that all ions of interest are constrained to follow the main flight path when the analyser field is switched on.

As already described, application of the first and second set of voltages to the one or more sets of electrodes adjacent the main flight path causes ions of interest to be separated from unwanted ions with the beam of ions that entered the analyser. In a preferred embodiment, when a desired degree of separation has been achieved the ions of interest are ejected from the analyser in an analogous way to the method of injection, i.e. when the ions of interest reach a suitable point upon the main flight path, the analyser field is switched off or switched to a lower magnitude than the main analyser field so that the ions of interest leave the main flight path and exit the analyser through an aperture in one of the outer field defining electrode structures. Only ions that were at the suitable point and travelling in a desired direction will leave the analyser at that time through the aperture and be travelling in a direction suitable for being received. Thereby a further degree of m/z selection is achieved. In a preferred embodiment, ions are ejected from the analyser in a direction perpendicular to the analyser axis z at a turning point within one of the opposing ion mirrors. (The preferred direction is perpendicular to the analyser axis z but does not intersect the analyser axis z.)

In a further ejection arrangement, the charged particles are initially ejected (e.g. deflected) from the main flight path (e.g. by a deflector or by acceleration electrodes), which in this context will be referred to as the first main flight path, so that the beam moves to a second main flight path at a larger or smaller radial distance from the analyser axis z. This second main flight path is preferably also a stable path within the analyser. In the case where the second main flight path is stable, the beam may traverse the analyser once again on the second main flight path, thereby substantially increasing the total flight path and enabling in some embodiments at least doubling the flight path length through the analyser thereby increasing resolution of the TOF separation. One or more sets of electrodes are preferably also provided adjacent the second main flight path for constraining the arcuate divergence of the ions of interest on the second main flight path. One or more additional belt electrode assemblies or other means may be provided, e.g. to support additional arcuate lenses to focus the beam on the second main flight path. The additional belt electrode assemblies may support or be supported by belt electrode assemblies existing for the first main flight path, e.g. via a mechanical structure. Optionally, such additional belt electrode assemblies may be provided with field-defining elements protecting them from distorting the field at other points in the analyser. Such elements could be: resistive coatings, printed-circuit boards with resistive dividers and other means known in the art. Optionally, in addition to the second main flight path, the same principle may be applied to provide third or higher main flight paths if desired, e.g. by ejecting to the third main flight path from the second main flight path and so on. Each such main flight path preferably has one or more sets of electrodes adjacent each such main flight path for constraining the arcuate divergence of the ions of interest. Optionally, after traversing the second (or higher) main flight path, the beam may be ejected back to the first (or another) main flight path, e.g. to begin a closed path TOF.

The charged particles that follow the ejection trajectory may enter a receiver. As used herein, a receiver is any charged particle device that forms all or part of a detector or device for further processing of the charged particles. Accordingly the receiver may comprise, for example, a post accelerator, a conversion dynode, a detector such as an electron multiplier, a collision cell, an ion trap, a mass filter, a mass analyser of any known type including a TOF or EST mass analyser, an ion guide, a multipole device or a charged particle store.

The analyser of the present invention may be coupled to an ion generating means for generating ions, optionally via one or more ion optical components for transmitting the ions from the ion generating means to the analyser of the present invention. Typical ion optical components for transmitting the ions include a lens, an ion guide, a mass filter, an ion trap, a mass analyser of any known type and other similar components. The ion generating means may include any known means such as EI, CI, ESI, MALDI, etc. The ion optical components may include ion guides etc. The analyser of the present invention and a mass spectrometer comprising it may be used as a stand-alone instrument for mass analysing charged particles, or in combination with one or more other mass analysers, e.g. in a tandem-MS or $MS^n$ spectrometer. The analyser of the present invention may be coupled with other components of mass spectrometers such as collision cells, mass filters, ion mobility or differential ion mobility spectrometers, mass analysers of any kind etc. For example, ions from an ion generating means may be mass filtered (e.g. by a quadrupole mass filter), guided by an ion guide (e.g. a multipole guide such as flatapole), stored in an ion trap (e.g. a curved linear trap or C-Trap), which storage may be optionally after processing in a collision or reaction cell, and finally injected from the ion trap into the analyser of the present invention. It will be appreciated that many different configurations of components may be combined with the analyser of the invention. The present invention may be coupled, alone or with other mass analysers, with one or more another analytical or separating instruments, e.g. such as a liquid or gas chromatograph (LC or GC) or ion mobility spectrometer.

In some preferred embodiments, when the electrode systems are electrically biased the mirrors create an electrical field comprising opposing electrical fields along z; wherein the opposing electrical fields are different from each other.

However, preferably the opposing electrical fields are the same as each other. Preferably both the inner and outer field defining electrode systems of both opposing mirrors are the same as each other. Thus, the main analyser field in the analyser volume is preferably symmetrical about z=0. Preferably both of the inner and outer field-defining electrode systems of one of the mirrors is held at the same set of one or more electrical potentials to the corresponding one or both of the inner and outer field-defining electrode systems of the other mirror.

The present invention provides, in some embodiments, a method of separating charged particles enabling a compact, high resolution, unlimited mass range TOF mass separator which embodies near-perfect angular and time focusing characteristics with a minimum of high tolerance components. In some other embodiments, the mass range may be limited in order to further increase the mass resolution. The construction of the analyser may be made with a small number of high tolerance components. In particular, the analyser according to the present invention requires only two opposing mirrors each comprising two electrode systems. Moreover, in some embodiments, a simple construction comprising only two field-defining electrode systems can be employed in order to provide both mirrors as herein described. Accordingly, the analyser preferably has only two opposing mirrors.

Further advantages may be obtained by arranging a plurality of analysers of the present invention in a parallel array, as will be further described.

DETAILED DESCRIPTION

In order to more fully understand the invention, various embodiments of the invention will now be described by way of examples only and with reference to the Figures. The embodiments described are not limiting on the scope of the invention.

Figure 1:
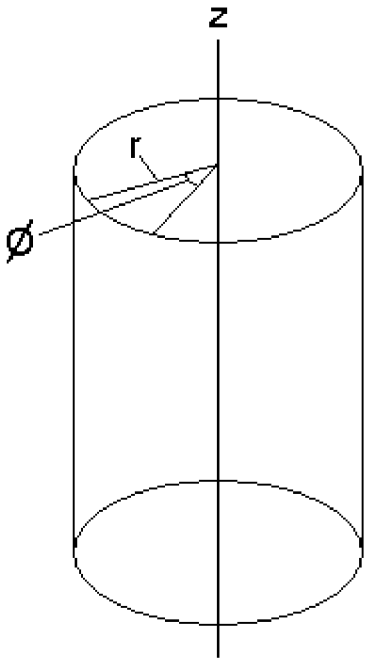
FIG. 1 illustrates the coordinate system used to describe features of the present invention.
Figure 2:
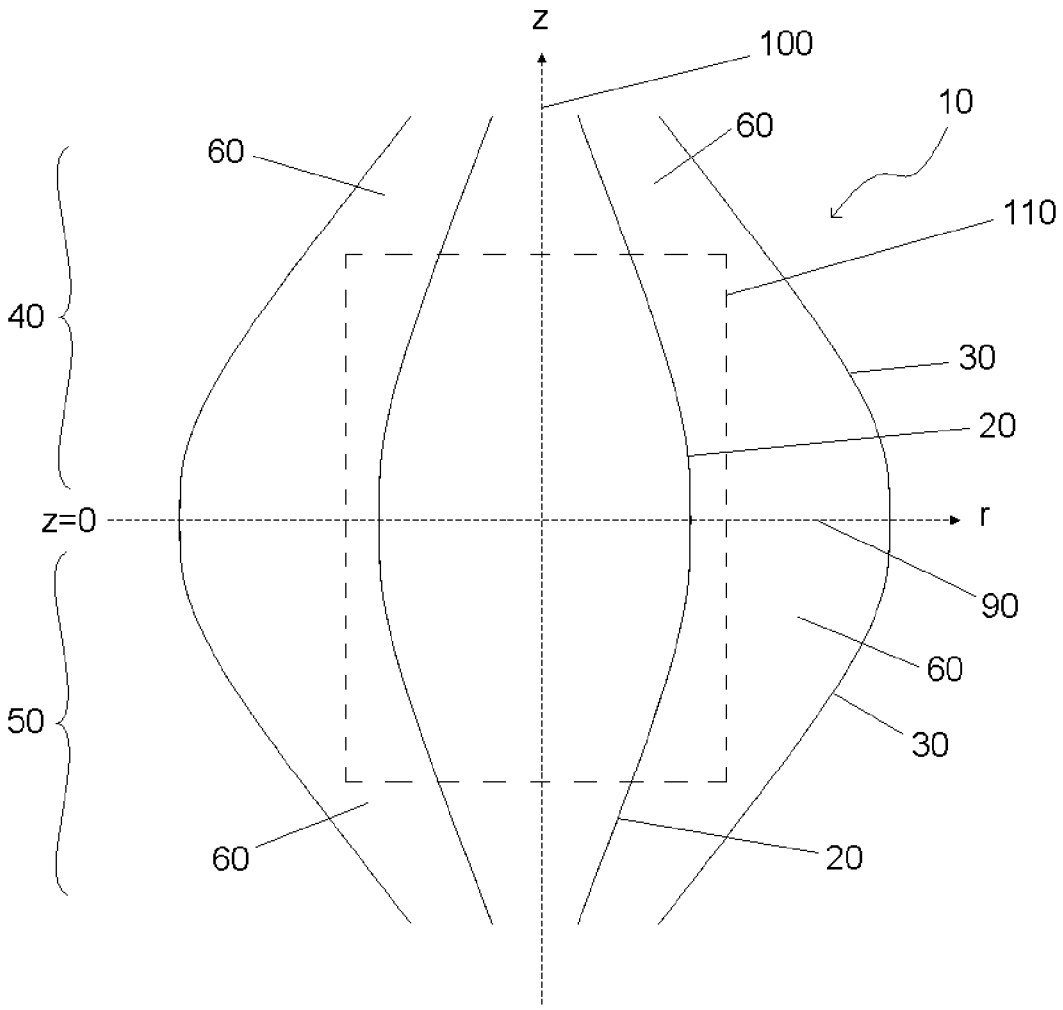
FIG. 2 shows a schematic view of the inner and outer field defining electrode structures of the two opposing mirrors for a preferred embodiment of the invention.

One preferred embodiment of the present invention utilises the quadro-logarithmic potential distribution described by equation (1) as the main analyser field. FIG. 2 is a schematic cross sectional side view of the electrode structures for such a preferred embodiment. Analyser 10 comprises inner and outer field-defining electrode systems, 20, 30 respectively, of two opposing mirrors 40, 50. The inner and outer field-defining electrode systems in this embodiment are constructed of gold-coated glass. However, various materials may be used to construct these electrode systems: e.g. Invar; glass (zerodur, borosilicate etc) coated with metal; molybdenum; stainless steel and the like. The inner field-defining electrode system 20 is of spindle-like shape and the outer field-defining electrode system 30 is of barrel-like shape which annularly surrounds the inner field-defining electrode system 20. The inner field-defining electrode systems 20 and outer field-defining electrode systems 30 of both mirrors are in this example single-piece electrodes, the pair of inner electrodes 20 for the two mirrors abutting and electrically connected at the z=0 plane, and the pair of outer electrodes for the two mirrors also abutting and electrically connected at the z=0 plane, 90. In this example the inner field-defining electrode systems 20 of both mirrors are formed from a single electrode also referred to herein by the reference 20 and the outer field-defining electrode systems 30 of both mirrors are formed from a single electrode also referred to herein by the reference 30. The inner and outer field-defining electrode systems 20, 30 of both mirrors are shaped so that when a set of potentials is applied to the electrode systems, a quadro-logarithmic potential distribution is formed within the analyser volume located between the inner and outer field-defining electrode systems, i.e. within region 60. The quadro-logarithmic potential distribution formed results in each mirror 40, 50 having a substantially linear electric field along z, the fields of the mirrors opposing each other along z. The shapes of electrode systems 20 and 30 are calculated using equation (1), with the knowledge that the electrode surfaces themselves form equipotentials of the quadro-logarithmic form. Values for the constants k, C and $R_m$ are chosen and the equation solved for one of the variables r or z as a function of the other variable z or r. A value for one of the variables r or z is chosen at a given value of the other variable z or r for each of the inner and outer electrodes and the solved equation is used to generate the dimensions of the inner and outer electrodes 20 and 30 at other values of r and z, defining the inner and outer field-defining electrode system shapes.

For illustration, in one example of an analyser as shown schematically in FIG. 2, the analyser has the following parameters. The z length (i.e. length in the z direction) of the electrodes 20, 30 is 380 mm, i.e. +/−190 mm about the z=0 plane. The maximum radius of the inner surface of the outer electrode 30 lies at z=0 and is 150.0 mm. The maximum radius of the outer surface of the inner electrode 20 also lies at z=0 and is 95.0 mm. The outer electrode 30 has a potential of 0 V and the inner electrode 20 has a potential of −2587 V in order to generate the main analyser electrical field in the analyser volume under the influence of which the charged particles will fly through the analyser volume as herein described. The voltages given herein are for the case of analysing positive ions. It will be appreciated that the opposite voltages will be needed in the case of analysing negative ions. The values of the constants of equation (1) are: $k=1.42*10^5$ $V/m^2$, $R_m$=307.4 mm, C=0.0.

The inner and outer field-defining electrode systems 20, 30 of both mirrors are concentric in the example shown in FIG. 2, and also concentric with the analyser axis z 100. The two mirrors 40, 50 constitute two halves of the analyser 10. A radial axis is shown at the z=0 plane 90. The analyser is symmetrical about the z=0 plane. For a TOF analyser of this size able to achieve high mass resolving power such as 50,000, the alignment of the mirror axes with each other should be to within a few hundred microns in displacement and between 0.1-0.2 degrees in angle. In this example, the accuracy of shape of the electrodes is within 10 microns. Ions would travel on a stable flight path through the analyser even at much higher misalignment but the mass resolving power would reduce.

Figure 3A:
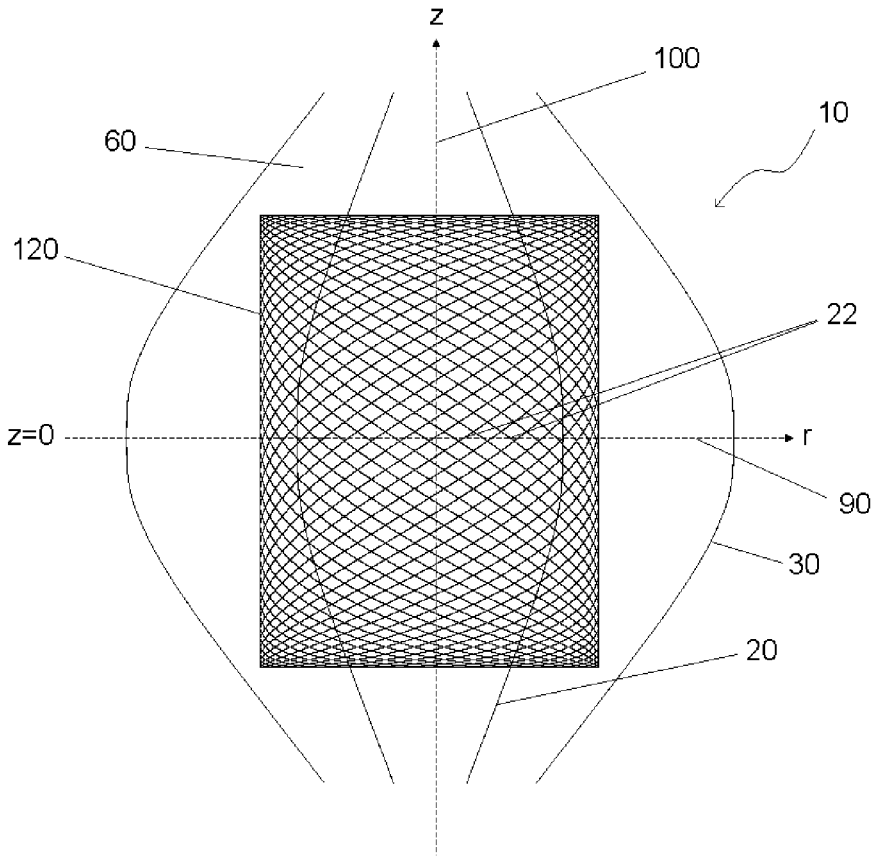
FIG. 3 shows schematically examples of main flight paths of the beam and beam envelopes, in embodiments of the invention.
Figure 3B:
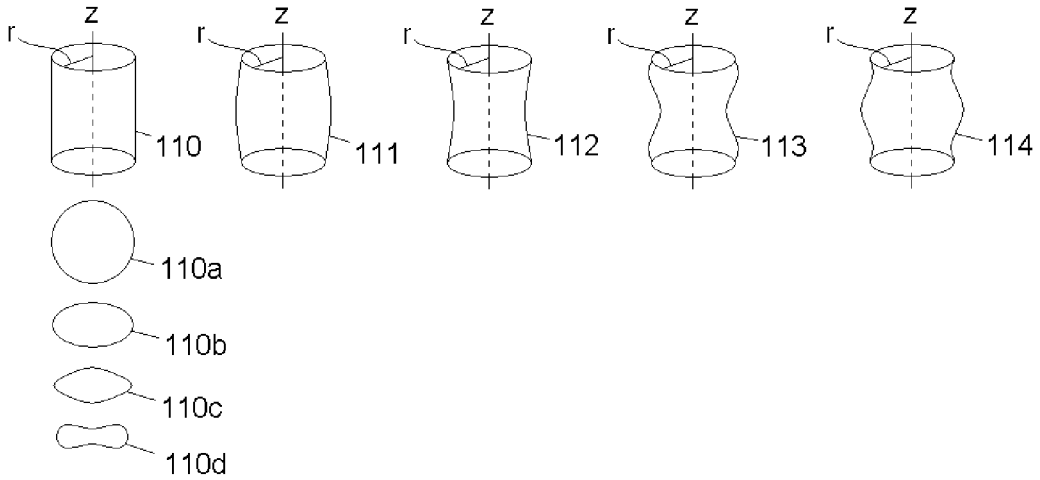

The main flight path within the analyser shown in FIG. 2 is within a cylindrical envelope 110 of radius approximately 100 mm and maximum distance from the z=0 plane of 138 mm. The main flight path comprises a reflected helical trajectory 120 between the two mirrors (i.e. around the inner electrode 20 between the inner electrode 20 and outer electrode 30) as shown in the schematic diagram of FIG. 3*a*, where like components have been given the same labels as in FIG. 2. In some preferred embodiments of the present invention, such as the embodiment depicted schematically in FIGS. 2 and 3, the radial distance of the main flight path of the beam from the z axis does not change from one axial oscillation to another axial oscillation. In the embodiment shown in FIG. 3*a* the main flight path undergoes 36 full oscillations along the z axis before reaching its starting point once again. Each oscillation along the z axis is simple harmonic motion. The helical trajectory 120 of FIG. 3*a* shows the main flight path as though the inner field-defining electrode systems of the mirrors were not present, i.e. the main flight path is shown unobscured by the inner field-defining electrode systems and there are 36 separate points visible at which the main flight path crosses the z=0 plane, (though those at the extremes in r are difficult to resolve in the figure). A further 36 points are present but obscured, giving a total of 72, as the trajectory behind the inner field-defining electrode systems lies exactly behind the trajectory that passes in front of the inner field-defining electrode system, the latter trajectory obscuring the former. The principal parameters of the field have been chosen so that the orbiting (i.e. arcuate) frequency and the axial (z direction) oscillating frequency are such as to cause the beam of ions to pass through the z=0 plane at predetermined positions, such as those marked 22. The main flight path is inclined at 55.96 degrees to the z axis at the z=0 plane, and progresses around the z axis on the plane z=0 (i.e. each time it passes the z=0 plane) at 5 degree intervals, thereby reaching its starting point after 72 half oscillations or reflections. In use, a beam of ions following the main flight path has an arcuate velocity corresponding to 3000 eV kinetic energy and an axial velocity corresponding to 1217.5 eV kinetic energy when at the plane z=0. The total beam energy is 4217.5 eV. In this particular embodiment, after 36 full oscillations along z (equal to 72 passes across the z=0 plane), the beam travels approximately 9.94 m in the analyser axial direction, which is the direction of time of flight separation of the ions, before reaching its starting point once again. This is due to the particles travelling the z length of the cylindrical envelope 110 twice (i.e. back and forth) for each full oscillation along z (i.e. a distance per oscillation of 138 mm×2=276 mm but an effective distance of 138 mm×2π=867 mm). For 36 full oscillations, the total effective length travelled is therefore 867 mm×36=31.2 m. The beam orbits around the z axis just over once (i.e. 5 degrees over) per reflection from one of the mirrors, i.e. just over twice (i.e. 10 degrees over) per full oscillation along the z axis.

Whilst the main flight path of FIG. 3*a* is a helical path of constant radius, other analysers utilising the present invention are also possible which produce different flight path envelope shapes. Some non-limiting examples of shapes of the main flight path envelope are shown schematically in FIG. 3*b*, at 110, 111, 112, 113, 114. Each of these envelope shapes may also have, for example, any of the cross sectional shapes shown at 110*a*, 110*b*, 110*c*, and 110*d*.

The trajectory 120 shown in FIG. 3*a* is an example of the main flight path executed within the analyser when a plurality of arcuate focusing lenses is utilised to constrain the arcuate divergence of the ion beam, in which case the lenses are preferably located at or near the z=0 plane 90, and spaced around the analyser radially so as to intercept the main flight path as it increments around the analyser axis in the arcuate direction. In this case there are 36 arcuate focusing lenses, but there could be less if the beam were to encounter a lens after two or more oscillations. However in more preferred embodiments which utilise one or two arcuate focusing lenses only, the main flight path does not so increment around the analyser axis but follows a helical path which rotates around the analyser axis by $n*\pi$ angular rotations of the analyser per reflection where n is an odd integer when there are two arcuate focusing lenses, or by $N*\pi$ angular rotations of the analyser per reflection, where N is an even integer when there is one arcuate focusing lens. In the case where there are two arcuate focusing lenses they lie on radially opposite sides of the analyser, located on a line passing through the z axis.

Figure 4A:
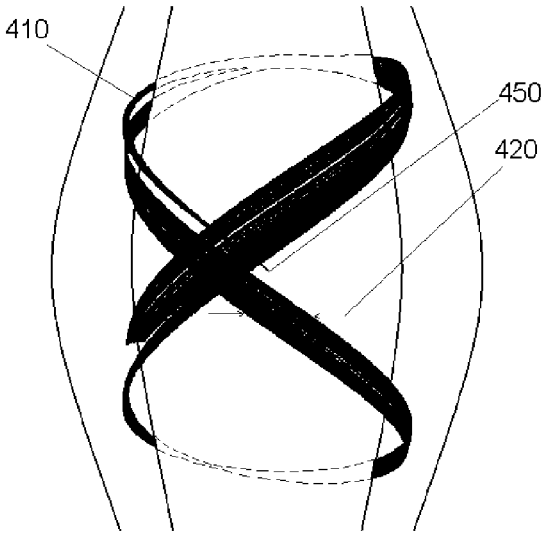
FIG. 4 shows schematic representations of a beam of ions undergoing oscillations in an analyser according to the invention with (FIG. 4*b*) and without (FIG. 4*a*) arcuate focusing lenses, and an example of an arcuate focusing lens (FIG. 4*c*).
Figure 4B:
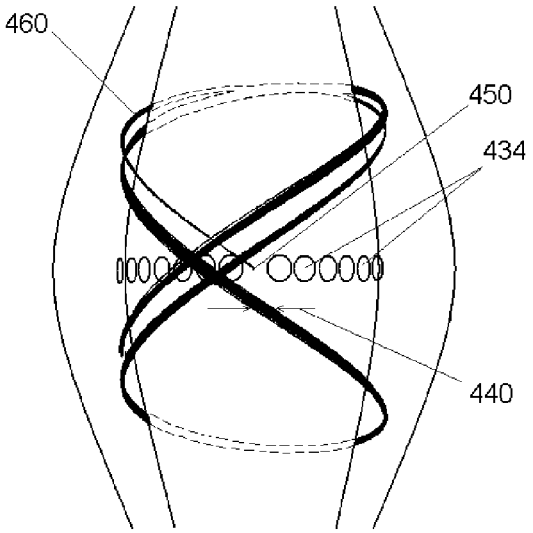

As previously described, in the absence of the action of the arcuate lenses, whilst travelling upon the main flight path, the beam is confined radially but is unconstrained in its arcuate divergence within the analyser. FIG. 4*a* shows a schematic representation of a beam of ions 410 undergoing less than two axial oscillations in a quadro-logarithmic potential analyser similar to that in FIGS. 2 and 3, illustrating the beam spread in the arcuate direction, 420, after just less than one axial oscillation. FIG. 4*b* shows a similar beam 460 in a similar analyser but in which a plurality of arcuate focusing lens assemblies has been incorporated. These arcuate focusing lens assemblies or lenses comprise at least some of the sets of electrodes adjacent the main flight path according to the present invention. The arcuate lens assemblies comprise two opposing circular lens electrodes in the form of plates, 432, 434 shown in FIG. 4*c*. FIG. 4*b* only shows the inner plates 434 for clarity. FIG. 4*b* also shows the resultant reduced arcuate beam spread, 440, which can be maintained for many oscillations of the beam. The beam starts from position 450 in both cases, with the same beam divergence. It will be understood from FIG. 4*a* that without arcuate focusing only a very limited path length within the analyser is possible without substantial beam broadening, causing the attendant problems of ejection and detection as already described. FIG. 4*b* illustrates that beam divergence in the arcuate direction can be controlled allowing a far greater number of reflections. If there is sufficient arcuate focusing, the beam path without overlapping is in principle of unlimited length. In the present invention, the application of the first set of voltages to the one or more sets of electrodes adjacent the main flight path provides the requisite arcuate focusing to the ions of interest within the ion beam to constrain the beam in the arcuate direction, enabling a confined beam to be mass selected. The application of the second set of voltages to the one or more sets of electrodes adjacent the main flight path provides less arcuate focusing to unwanted ions within the beam, and more preferably a disrupting action upon the unwanted ions within the beam.

Figure 4C:
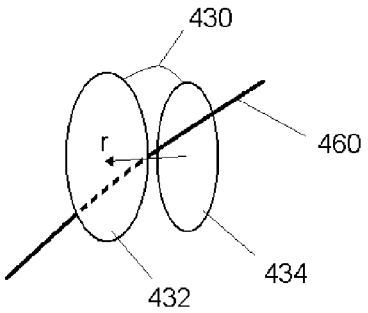

In the example shown schematically in FIG. 4*b*, the arcuate lenses, comprising at least some of the sets of electrodes adjacent the main flight path, 430 each comprise a pair of opposing circular lens electrodes, positioned around the z=0 plane at 10 degree spacing in the arcuate angle, to intercept the beam as it crosses the z=0 plane. One electrode 434 of each lens 430 is at a smaller radius from the z axis than the beam, and the opposing electrode 432 of the same lens 430 is at larger radius from the z axis than the beam, the beam passing between the two opposing electrodes 432, 434 as shown in FIG. 4*c*. In FIG. 4*b*, for clarity, only the circular electrodes 434 of each pair at smaller radius are shown. The opposing lens electrodes 434 and 432 are located in cylindrical annular belt electrode assemblies (not shown) at r=97 mm and 103 mm respectively and electrically insulated therefrom (where r=radius from the z axis). The belt electrode assembly at smaller radius is referred to herein as the inner belt electrode assembly and the belt electrode assembly at large radius is referred to herein as the outer belt electrode assembly. The belt electrode assemblies therefore lie closely radially on either side of the main flight path which is at r=100 mm. Further details of various embodiments of belt electrode assemblies are described below. The belt electrode assemblies are centred on the z=0 plane and are of z length 44 mm. The inner belt electrode assembly is electrically biased with a potential $U_1$=−2426.0 V and the outer belt electrode assembly is biased with a potential $U_2$=−2065.8 V, which are close to the potentials of the quadro-logarithmic potential in the analyser at the respective belt radii. Ideally the belt electrode assemblies would not be strict cylinders but would follow the contours (equipotential lines) of the quadro-logarithmic potential in the region in which they are placed, but in this example, cylindrical electrodes are used which are a reasonable approximation to the quadro-logarithmic potentials in that region. In order to avoid a step of the field at the point where the inner belt joins the inner electrode, the inner belt is made slightly smaller than the nominal diameter of the inner electrode at z=0. The inner belt electrode assembly has 36 equally spaced apertures each of diameter 14.9 mm in which the inner arcuate lens electrodes 434 are mounted, and the outer belt electrode assembly has 36 equally spaced apertures each of diameter 16.0 mm in which the outer arcuate lens electrodes 432 are mounted. In alternative embodiments, arcuate lens electrodes may be absent at the locations around the analyser axis z at which deflectors are placed to effect injection and ejection. In some preferred embodiments, the arcuate lenses themselves can act as deflectors when energised with deflecting potentials. In this example, the inner lens electrodes 434 are of diameter 13.0 mm and the outer lens electrodes 432 are of diameter 13.8 mm. The lens electrodes are mounted within the belt electrode assemblies upon insulators which thereby insulate the lens electrodes from the belt electrode assemblies. In other embodiments, the lens electrodes can be part of the belt electrode assembly.

The electrical potentials applied to the belt electrode assemblies may be varied independently of the potentials upon the inner and outer field-defining electrode systems or the lens electrodes, so that, for example, the beam satisfies the following conditions in some embodiments: (i) the radial distance of the beam from the z axis does not change from one axial oscillation to another axial oscillation; (ii) the half period of axial oscillations corresponds to the 10 degree arcuate angle of rotation at the z=0 plane per full oscillation, so that the beam is centred upon each arcuate focusing lens 430 as it passes through the z=0 plane after each full oscillation.

The spatial spread of the ions of interest in the arcuate direction $\phi$ should not exceed the diameter of the lens electrodes 434, 432 of the arcuate lenses 430 so that large high-order aberrations are not induced. This imposes a lower limit upon the potential applied to the lens electrodes. Large potentials applied to the lens electrodes should also be avoided so that distortions of the main analyser field are not produced. In this example, the ion beam is stable with up to +/−5 mm beam spread in the arcuate direction. With larger spread, the second order aberrations of the arcuate lenses become significant and after multiple reflections in the mirrors, some ions may extend outside the circular lens electrodes 432, 434. The arcuate lenses 430 also affect the ion beam trajectory in the radial direction to some extent, introducing some beam broadening in the radial direction, larger beam broadening occurring to those ions that start their trajectories with larger initial displacements radially. For example ions that start their trajectories at r=100.5 mm are retained radially to within approximately +/−1 mm, but particles that start their trajectories at r=101.0 mm are retained radially to within approximately +/−3.5 mm. A broadening of the beam of ions of interest radially may result in the loss of ions after multiple reflections in the analyser mirrors, and the arcuate lens designs must take account of this if the initial spatial extent of the ion beam in the radial direction is sufficiently large. Initial ion energy spread also affects the focusing of the arcuate lenses. In this example relative energy spreads $\Delta E/E$ up to +/−1%, radial spreads up to +/−0.3 mm and arcuate spreads up to +/−5 mm may be accommodated with only ~20% loss in transmission after 27 full oscillations in the z direction, and with over 80,000 resolving power (for an initial packet of ions having negligible temporal spread). An important advantage of this design is the ability to transmit a wide mass range of ions, disperse them in time far enough to provide high resolution of mass selection even using relatively simple deflectors or Bradbury-Nielsen gates. A large number of m/z windows could be selected from a single injection if desired.

Two further examples (Examples B and C) of the invention utilise a similar analyser to that described above (Example A), but alternative values for constants, dimensions and potentials are used, as listed in Table 1. Example B comprises an analyser containing two sets of electrodes adjacent the main flight path suitable for arcuate focusing, on the z=0 plane separated by 180 degrees in the arcuate direction. Ions orbit by $\pi/2$ from an entrance aperture to the first set of electrodes. The analyser comprises a disc which separates the two opposing mirrors, as will be further described. Example C comprises an analyser containing a single set of electrodes adjacent the main flight suitable for arcuate focusing consisting of a single electrode set into the outer field-defining electrode of both mirrors on the z=0 plane. In both examples, each set of electrodes adjacent the main flight path consist of a single electrode, located at a greater radial distance from the analyser axis than the main flight path and hence in Table 1 are provided with just two alternative potentials. These potentials are, respectively, the potential to be applied when the ions of interest are in the vicinity of the electrodes adjacent the main flight path (to induce arcuate focusing) and the potential to be applied when the ions of interest are not in the vicinity of the electrodes adjacent the main flight path (to induce beam deflection of unwanted ions).

Both the examples B and C are variants optimized for selecting one or a few m/z windows from a relatively narrow mass range which is a typical case for present-day mass spectrometry.

TABLE 1

| Parameter | Example B | Example C |
|---|---|---|
| z length of analyser | +/−35 mm | +/−20 mm |
| Maximum outer radius of the inner electrode | 48 mm | 9 mm |
| Maximum inner radius of the outer electrode | 55 mm | 12 mm |
| Injection radius | 50 mm | 10 mm |
| Main flight path radius | 50 mm | 10 mm |
| Maximum distance of main flight path from z = 0 plane | 18 mm | 10 mm |
| Injection axial coordinate | 18 mm | 10 mm |
| Injection energy | 1000 V | 4000 V |
| Outer electrode potential | 0 V | 0 V |
| Inner electrode potential | −264.2 V | −2275 |
| k | $8 * 10^5$ | $2 * 10^7$ |
| $R_m$ | 86.6 mm | 30 mm |
| C | 0 | 0 |
| Rotation per single axial reflection, | $\pi$ | $2 * \pi$ |
| Main flight path inclination to the z axis at z = 0 | 19.8 degrees | 26.56 |
| Effective path length in the axial (z) direction per full reflection | 113 mm | 62.8 |
| Total effective length of flight path per full reflection | 334 mm | 140.5 |
| Inner radius of the outer belt electrode assembly | 52 mm | N/A |
| Potential of the electrode adjacent the main flight path | 20 V/−200 V | 80 V/−1000 V |
| Arcuate focusing electrode assembly z length | 3 mm | 3 mm |
| Axial thickness of the belt | 2 mm | N/A |

Mass selectors of different sizes may be constructed from scaled versions of the examples given here. In particular, miniature mass selectors could be made by scaling examples B and C down by a factor of 10.

Figure 5A:
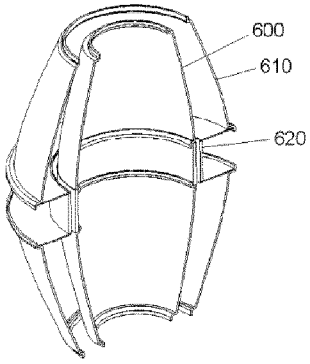
FIG. 5 shows schematic views of the electrode structures for various further embodiments of the invention.
Figure 5B:
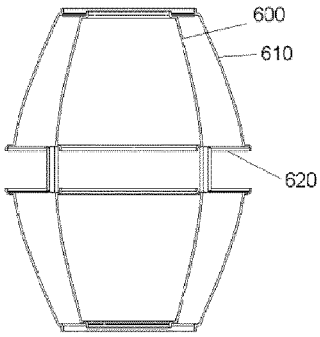
Figure 5C:
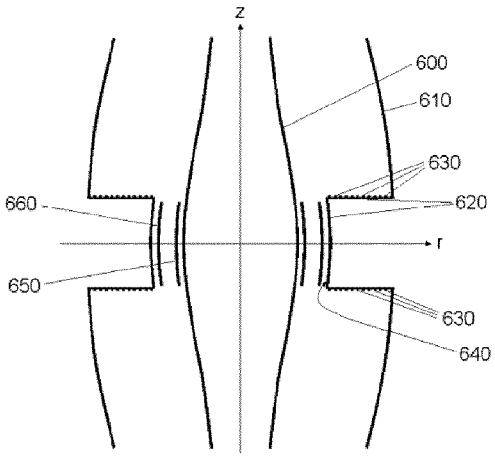

Example A given above for arcuate focusing lenses utilises belt electrode assemblies to support the lens electrodes, as already described. The inner belt electrode assembly is supported from the single inner field-defining electrode system 20 of both mirrors. The outer belt electrode assembly is supported from the single outer field-defining electrode system 30 of both mirrors. The inner belt electrode assembly has a radius only slightly larger than that of the inner field-defining electrode system at the z=0 plane and can conveniently be mounted to the inner field-defining electrode system via short insulators or an insulating sheet, for example. However the outer belt electrode assembly 20 has a radius considerably smaller than the radius of the outer field-defining electrode system at the z=0 plane. To facilitate mounting of the belt electrode, the outer field-defining electrode system structure 20 is preferably altered. A schematic illustration of a preferred outer field-defining electrode structure for mounting belt electrode assemblies is given in FIG. 5. FIGS. 5*a* and 5*b* show cross sectional side and cut-away perspective views respectively of the inner and outer field-defining electrode systems 600, 610 of two mirrors respectively. The outer field-defining electrode system 610 has a waisted portion 620 of reduced diameter, at a region near the z=0 plane. FIG. 5*c* shows a schematic side view cross section of the analyser where it can be seen that where the outer field-defining electrode system 610 waists in at 620, an array of electrode tracks 630 are positioned at different radial positions facing into the analyser. These electrode tracks are suitably electrically biased so that they inhibit the waisted portion of the outer field-defining electrode system from distorting the quadro-logarithmic potential distribution elsewhere within the analyser. The array of electrode tracks may be exchanged for a suitable resistive coating as an alternative, for example, or other electrode means may be envisaged. As termed herein, due to their function, the array of electrode tracks, resistive coating or other electrode means for inhibiting distortion of the main field form part of the outer field-defining electrode system of the mirror to which they relate. The inner surface 640 of the waisted portion 620 of the outer field-defining electrode system is used to support the outer belt electrode, 660 which in turn supports arcuate lens electrodes as previously described. Inner and outer belt electrode assemblies 650 and 660 respectively may then conveniently be mounted within the analyser from the inner and outer field-defining electrode systems 600, 610 respectively. The belt electrode assemblies 650 and 660 may be mounted from the inner and outer field-defining electrode systems 600, 610 via short insulators or an insulating sheet. In the example of FIG. 6*c*, both inner and outer belt electrode assemblies 650, 660 are curved to follow the contours of the quadro-logarithmic potential equipotentials where they are positioned, though simpler cylindrical sections could be used.

Figure 5D:
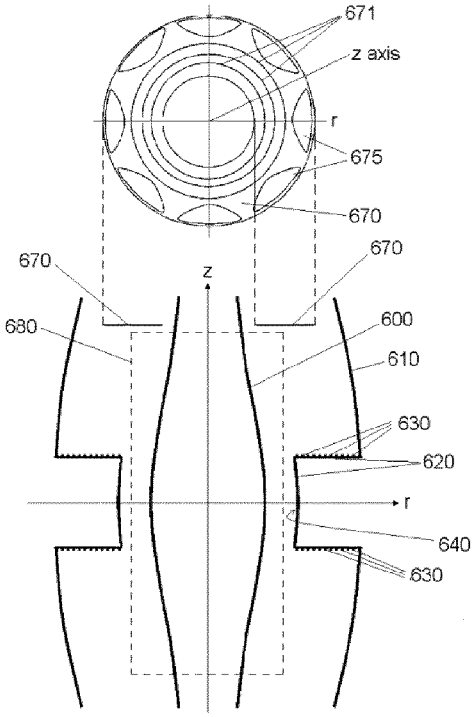

Electrode assemblies to support arcuate focusing lenses may be positioned anywhere near the main flight path within the analyser. An alternative embodiment to that in FIG. 5*c* is shown schematically in FIG. 5*d*. In this embodiment a single belt electrode assembly 670 that supports arcuate lenses is located adjacent the main flight path at one of the turning points. FIG. 5*d* shows both a side view cross section of the analyser and a view along the z axis of the belt electrode assembly 670 with arcuate lens electrodes 675 equally spaced about the analyser axis z. Only eight arcuate lens electrodes 675 are shown in this example; in other embodiments there may be more or less; preferably there would be one gap between adjacent arcuate lens electrodes for each full oscillation of the main flight path along the analyser axis z, so that arcuate focusing of the beam occurs each time the beam reaches the turning point adjacent the belt electrode assembly. The beam envelope in this embodiment is a cylinder 680. The belt electrode assembly 670 supporting the arcuate lenses 675 comprises a disc shaped plate with a central aperture through which passes the end of the inner field-defining electrode system 600. Electrode tracks 671 are mounted upon the belt electrode assembly 670, set in insulation. These electrode tracks 671 are each given an appropriate electrical bias to reduce distortion of the main analyser field in the vicinity of the belt electrode assembly 670.

Figure 6A:
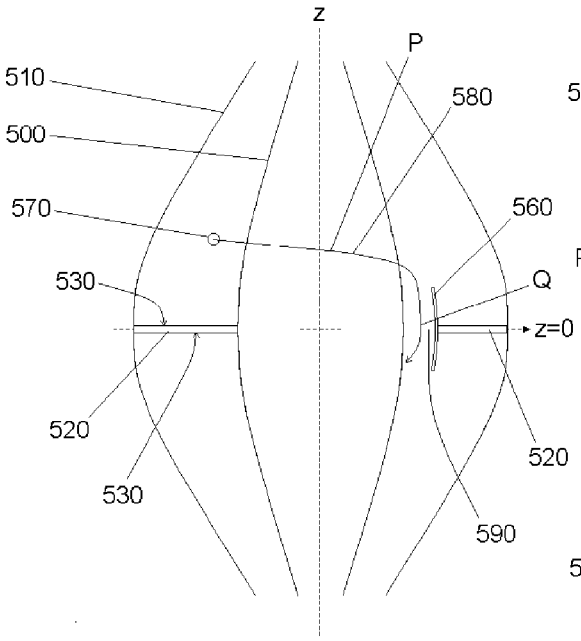
FIG. 6 shows schematic views of the electrode structures for a preferred embodiment of the invention.
Figure 6B:
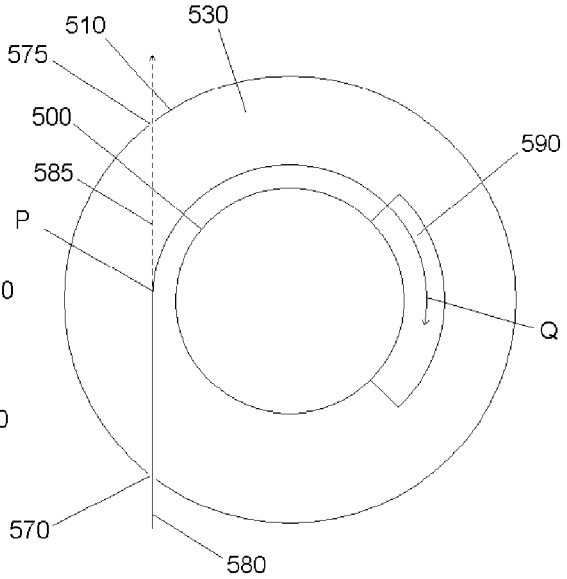

For simplicity and low cost of manufacture, as already described, more preferred embodiments utilise two, or only one, sets of electrodes adjacent the main flight path within the analyser. Additional advantages may be gained from using fewer sets of electrodes adjacent the main flight path, as will be described. A preferred embodiment which utilises a single arcuate focusing lens is shown schematically in FIG. 6. Inner field defining electrode systems 500 comprise a single electrode for both opposing mirrors. Outer field defining electrode systems 510 comprise a single electrode for both opposing mirrors. The z axis and z=0 plane are shown. FIG. 6*a* is a schematic side view of the analyser and FIG. 6*b* is a schematic transverse cross sectional view at z=0 plane. An entry aperture 570 in the outer field defining electrode system of one of the mirrors provides for entry of the ion beam 580 to the analyser (e.g. from a pulsed ion source such as a curved linear ion trap or C-trap). On entry to the analyser the analyser field is switched off, i.e. the analyser volume is field-free, and the beam follows a straight trajectory until it reaches point P upon the main flight path whereupon the analyser field is turned on and set to the main analyser field strength so that the ion beam 580 follows the main flight path. The analyser field is turned on, for analysers of similar characteristics as those in Examples A, B and C, so as to have a rise time from 10% to 90% of the analyser field in a time between 10 and 100 ns. If timescales longer than this are used (with 5-50 microsecond time constants being a preferable range), the ion beam 580 is instead directed towards a slightly different point than point P to take account of the beam motion through the changing analyser field. For cases in which a single range of m/z ions constitute the ions of interest within the beam, this embodiment benefits from utilising a pulsed ion source positioned such that there is at least some time of flight separation before ions enter the analyser. In such cases only some of the ions within the beam, which includes the ions of interest, will be at or close to the point P when the analyser field is switched on, and all other ions will not be induced to follow the main flight path, thereby achieving a degree of m/z separation during entry to the analyser.

The main flight path comprises a helix shaped trajectory which rotates around the z axis by $2\pi$ for every reflection in one of the opposing mirrors. Accordingly the main flight path returns to the vicinity of point Q after every reflection. This enables the analyser to be constructed in a slightly different way to the analysers described earlier. The analyser of this embodiment comprises a disc 520 spanning the space between the inner and outer field defining electrode systems 500, 510. This disc is coated with a resistive coating 530 on both sides which is electrically connected to the inner field defining electrode system where it abuts the inner field defining electrode system and coating 530 is electrically connected to the outer field defining electrode system where it abuts the outer field defining electrode system. The coating thereby assumes an electrical potential which matches the potential that would have been present had there been no disc 520 present. The presence of disc 520 thereby does not disturb the field within the analyser. The disc 520 is preferably 1-5 mm thick. The disc 520 comprises a slot 590 through which the main flight path passes. Attached to one side of the slot 590 is an arcuate lens electrode 560 (shown in FIG. 6*a* only) located in the vicinity of point Q, so that after every reflection the main flight path passes close to arcuate lens electrode 560. Arcuate lens electrode 560 is in this example a single electrode adjacent the main flight path. In other embodiments an opposing pair of electrodes may be used, with electrode 560 having an opposing electrode of similar size and shape attached via an insulator to the surface of the inner electrode on the other side of the main flight path near point Q. Arcuate lens electrode 560 may be energised at a first time and for a first time period by applying a first set of one or more voltages to induce an arcuate focusing action upon the ions of interest passing in the vicinity of point Q. Arcuate lens electrode 560 may be energised at a second time and for a second time period by applying a second set of one or more voltages to induce a disruptive (i.e. defocusing or more preferably deflecting) action upon unwanted ions passing in the vicinity of point Q. Advantageously, disc 520 acts as an electrical shield so that ions further away from point Q are not influenced significantly by the voltages applied to arcuate lens electrode 560 thereby enabling the second time period to be commenced shortly after the ions of interest have passed point Q. The second time period may be continue until the ions of interest have completed a reflection and are once again approaching point Q, whereupon the second set of voltages may be switched off and the first set of voltages switched on again and so on. The presence of disc 520 with its electrically shielding action thereby enables the switching of sets of voltages upon the arcuate lens electrode to be accomplished in a way that more rapidly separates ions of interest from unwanted ions. Disc 520 also obviates the need to construct the analyser with a waisted-in portion as was described in relation to FIG. 5 at 620. The action of the second set of voltages applied to the arcuate focusing lens 560 causes unwanted ions to leave the main flight path and impact either disc 520 or the inner or outer field defining electrode systems and thereby be separated from the ions of interest. The first and second set of voltages may or may not be the only set of voltages applied to the arcuate focusing lens 560. Optionally a third set of voltages may be applied to the arcuate focusing lens 560 at various times, the third set of voltages being such as to neither induce arcuate focusing, nor to induce beam deflection. The third set of voltages in this embodiment causes no significant change to the packets of ions passing in the vicinity of the arcuate lens. Optionally the third set of voltages is applied to the arcuate focusing lens in place of the second set of voltages, for example, for 9 out of every 10 reflections, or in another embodiment for 49 out of every 50 reflections, so that the beam deflection effected by application of the second set of voltages only affects unwanted ions and never affects ions of interest due to overlapping packets having different m/z being in the vicinity of the arcuate focusing lens when the second set of voltages is applied. The choice of period for switching between the second set of voltages and the third set of voltages may be determined by a basic knowledge of the spectrum of ions to be injected into the analyser together with the choice of ions of interest to be selected.

Aperture 575 (shown in FIG. 6*b* only) provides means for ion beam 585 to exit the analyser. Ion beam 585 is a mass selected ion beam comprising ions of interest which travels along a straight line from the main flight path through exit aperture 575 when the analyser field is turned off. The analyser field is turned off when the ions of interest have been sufficiently separated from unwanted ions and when the ions of interest have reached a suitable point on the main flight path, as previously described. The analyser field is turned off in the present embodiment by simply reducing the electrical potential applied to the inner field defining electrode systems of both mirrors to 0V, the outer field defining electrode system of both mirrors being at 0V at all times. The analyser field is turned off, dropping from 90% to 10% field strength within a timescale of 10-100 ns, for analysers of similar characteristics as those in examples A, B and C. If longer timescales than this are used (with 5-50 microsecond time constants being a preferable range), the location of aperture 575 is adjusted to take account of the ion motion through the changing analyser field.

Alternatively, aperture 575 may be used to transmit an ion beam straight through the analyser with no mass selection; ions entering through aperture 570 and travelling straight through to aperture 575 with the analyser field switched off.

The embodiment of FIG. 6 is an embodiment illustrating a preferred construction comprising disc 520 with slot 590 to provide shielding, a single arcuate focusing lens conveniently attached to disc 520, and apertures 570 and 575 to provide simple means for injecting ions into the analyser and ejecting mass selected ions out from the analyser. Alternative embodiments have the disc 520 situated perpendicular to the analyser axis but displaced from the z=0 plane. Other embodiments utilise various constructions of belt electrodes 650, 660 such as those depicted in FIG. 5.

Example B described above comprises an analyser containing a disc similar to disc 520 of FIG. 6, but the disc in the case of the analyser of Example B has two slots, one corresponding to the location of each set of electrodes adjacent the main flight path.

Figure 7:
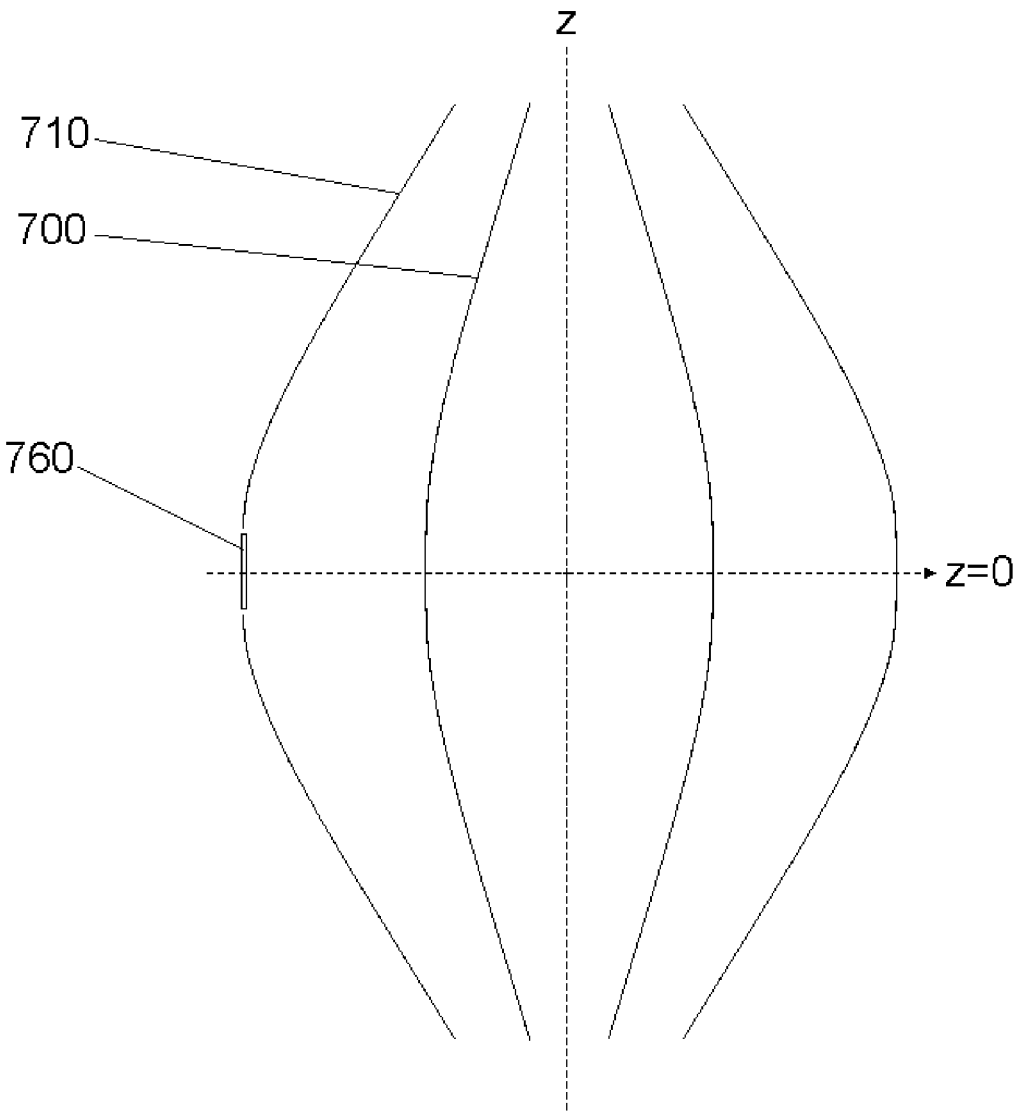
FIG. 7 shows schematic views of the electrode structures for a further embodiment of the invention.

An alternative embodiment is illustrated schematically in FIG. 7. Inner field defining electrode systems 700 comprise a single electrode for both opposing mirrors. Outer field defining electrode systems 710 comprise a single electrode for both opposing mirrors. The z axis and z=0 plane are shown. FIG. 7 is a schematic side view of the analyser. In this embodiment a single arcuate focusing lens is again used, but is in this embodiment the arcuate focusing lens 760 is located within, but electrically insulated from, the outer field defining electrode structure of both mirrors, on the z=0 plane. No disc 520 depicted in FIG. 6 is used. In this embodiment the second set of voltages is applied to the arcuate focusing lens 760 when the ions of interest are around the other side of the inner field defining electrode structures of the mirrors from the arcuate lens so that the inner field defining electrode structures of the mirrors shield the ions of interest from the changing voltage on the arcuate lens. Similar apertures to those in FIG. 6 for beam entry and exit are used, but are not shown in the figure, and similar methods for beam entry and exit are utilised. This embodiment is a slightly simpler construction to that depicted in FIG. 6, but it does not have the advantage of the shielding afforded by disc 520, and so is unable to separate ions of interest from unwanted ions quite so rapidly. In other embodiments, the arcuate focusing lens may be positioned adjacent the outer or inner field defining electrode structures of the mirrors.

Analysers used with methods of the present invention are able to operate at high resolving powers, such as 20,000-100,000 RP for example. Analysers of the sizes described in examples A and B are able to separate ions at these resolving powers after several thousands of reflections.

Figure 8A:
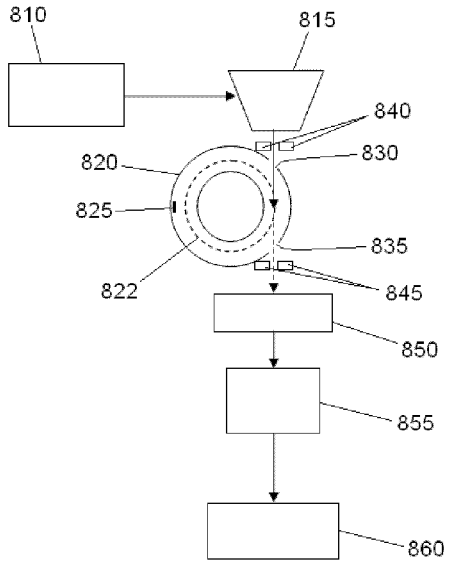
FIG. 8 depicts schematically a preferred instrumental layout utilizing an embodiment of the present invention.

Analysers of the present invention may be used in instruments comprising multiple additional components. FIG. 8*a* depicts schematically a preferred instrumental layout utilizing an embodiment of the present invention. Ioniser 810 supplies ions to a pulsed ion source (in this example a curved linear ion trap or C trap as described for example in WO2008/081334) 815. C trap 815 accumulates ions and ejects them in a packet to the analyser of the present invention 820. Analyser 820 comprises a single set of electrodes 825 adjacent the main flight path 822 within the analyser. Fringe field correction optics 840, 845 are located outside analyser 820 adjacent the entry and exit apertures 830, 835 of the analyser 820. Entry and exit apertures 830, 835 lie upon the same straight line. Fringe field correction optics 840, 845 are biased electrically and shaped so as to produce such electric fields during the m/z separation process that the presence of apertures 830, 835 does not distort the analyser field to any significant amount. Ions pass through fringe field correction optics 840 and enter analyser 820 through entry aperture 830, during this time correction optics are energized to produce fields optimum for transmitting the ion beam to its destination. The analyser 820 is operated in accordance with the method of the present invention, ions follow a main flight path 822 and a packet of ions of one or more narrow mass ranges emerge from the analyser through exit aperture 835, and enter a decelerator 850 being then transmitted to a collision cell 855. The packet of ions is fragmented within collision cell 855 and fragment ions are passed on to mass analyser 860. Collision cell 855 may be used to implement any of collision induced dissociation (CID), higher energy collisional dissociation (HCD), electron transfer dissociation (ETD), electron capture dissociation (ECD), or surface induced dissociation (SID). Mass analyser 860 may comprise any type of mass analyser which does not require a short duration high energy packet of ions, such as Fourier transfer ion cyclotron resonance (FT-ICR), RF ion trap, quadrupole mass filter or magnetic sector. In this instrumental configuration, as entry and exit apertures 830, 835 lie upon the same straight line, the analyser 820 may, for some experiments, be un-energized as ions pass from entry to exit aperture and the ions are then not mass selected but follow an undeflected path through the analyser and on to the decelerator 850.

The analyser of example C may be utilised as analyser 820. The frequency of ion oscillations in this analyser lies in the region of 350 kHz for ions of m/z of 400. If C-trap pulsed ion source 815 is utilised to focus ions to a spot of about 0.5 mm diameter at the entry aperture 830, only around 5 ms are sufficient for separating isobars 10 mDa apart. This 5 ms time duration matches well with the cooling cycle in the C-trap pulsed ion source 815 and allows it to operate at 200 Hz repetition rate. As C-trap pulsed ion source 815 is capable of injecting up to $10^6$ ions per injection shot, it means that it could process up to $2*10^8$ ions/sec. This is only several times lower than total ion current provided by the brightest of modern ion sources (up to $10^9$, at most $10^{10}$ ions/sec). This means that not more than a crude pre-selection prior to storage in the C-trap pulsed ion source is required to match the speed of this analyser with the most demanding requirements for mass selection. Such crude pre-selection could be implemented as a low-resolution quadrupole filter prior to the C-trap pulsed ion source or via DC biasing of the C-trap pulsed ion source itself (thus turning it into a resolving quadrupole).

Figure 8B:
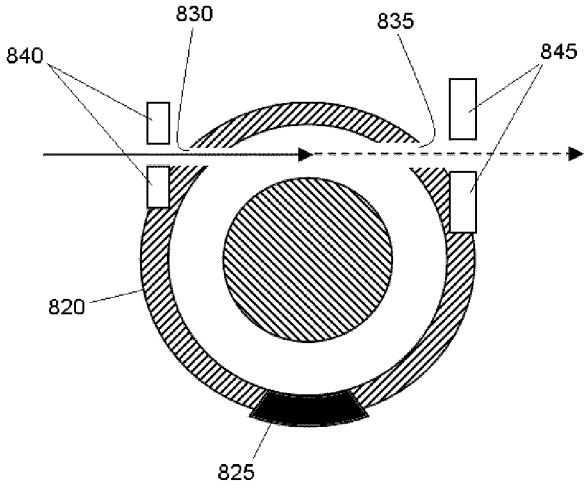

FIG. 8*b* schematically depicts an example of analyser 820. The single set of electrodes 825 comprise a single electrode set into but electrically insulated from the outer field defining electrode system of one of the opposing mirrors. Entry fringing field compensators comprise a disc electrode 840 with a 1 mm diameter aperture. Exit fringing field compensators comprise a disc electrode 845 with a 2 mm diameter aperture. Part of both entry and exit fringing field compensators are set into but electrically insulated from the outer field defining electrode system of one of the opposing mirrors.

Figure 9:
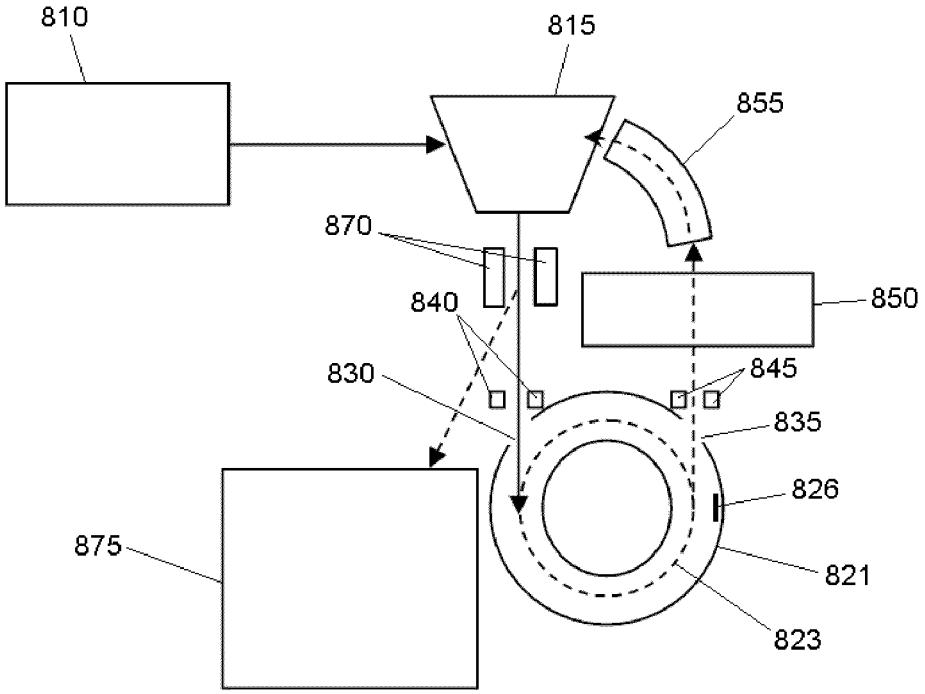
FIG. 9 depicts schematically a further preferred instrumental layout utilizing an embodiment of the present invention.

FIG. 9 depicts schematically a further preferred instrumental layout utilizing an embodiment of the present invention, in which like components to those described in relation to FIG. 8*a* are given the same identifiers. Ioniser 810 supplies ions to a C trap pulsed ion source 815. As an alternative to the C-trap, any other external storage device could be used as the pulsed ion source 815 such as RF or electrostatic storage, gas-filled or vacuum, including but not limited to: Paul trap, linear RF trap, orthogonal accelerator, storage ring or in-line trap, etc. C trap 815 accumulates ions and ejects them in a packet to the analyser of the present invention 821. Ions ejected from the C trap 815 pass through deflector 870. Deflector 870 is un-energized when ions are to be passed into the analyser 821. Analyser 821 comprises a single set of electrodes 826 adjacent the main flight path 823. Fringe field correction optics 840, 845 are located outside analyser 821 adjacent the entry and exit apertures 830, 835 of the analyser 821. Entry and exit apertures 830, 835 do not lie upon the same straight line. Fringe field correction optics 840, 845 are biased electrically and shaped so as to produce electric fields so that the presence of apertures 830, 835 does not distort the analyser field to any significant amount. Ions pass through fringe field correction optics 840 and enter analyser 821 through entry aperture 830. The analyser 821 is operated in accordance with the method of the present invention, ions follow a main flight path 823 and a packet of ions of one or more narrow mass ranges emerge from the analyser through exit aperture 835, and enter a decelerator 850 being then transmitted to a collision cell 855. The packet of ions is fragmented within collision cell 855 and fragment ions are passed back to the C trap pulsed ion source 815. The ability to pass ions back to the C trap 815 is facilitated by the analyser 821 comprising entry and exit apertures which do not lie upon a straight line. Fragmented ions are then ejected in a packet from C trap 815 and pass through deflector 870, which is energized, and which deflects the packet of ions to a second analyser 875. Alternatively, the fragmented ions can be sent to the analyser 821 and further mass selected therein before further fragmentation in collision cell 855 in $MS^n$ experiments. Collision cell 855 may be used to implement any of CID, HCD, ETD, ECD, or SID. Analyser 875 may comprise any type of mass analyser requiring a short duration high energy packet of ions, such as an electrostatic orbital trap (e.g. an Orbitrap™), single or multi-reflection TOF, or electrostatic trap.

Figure 10:
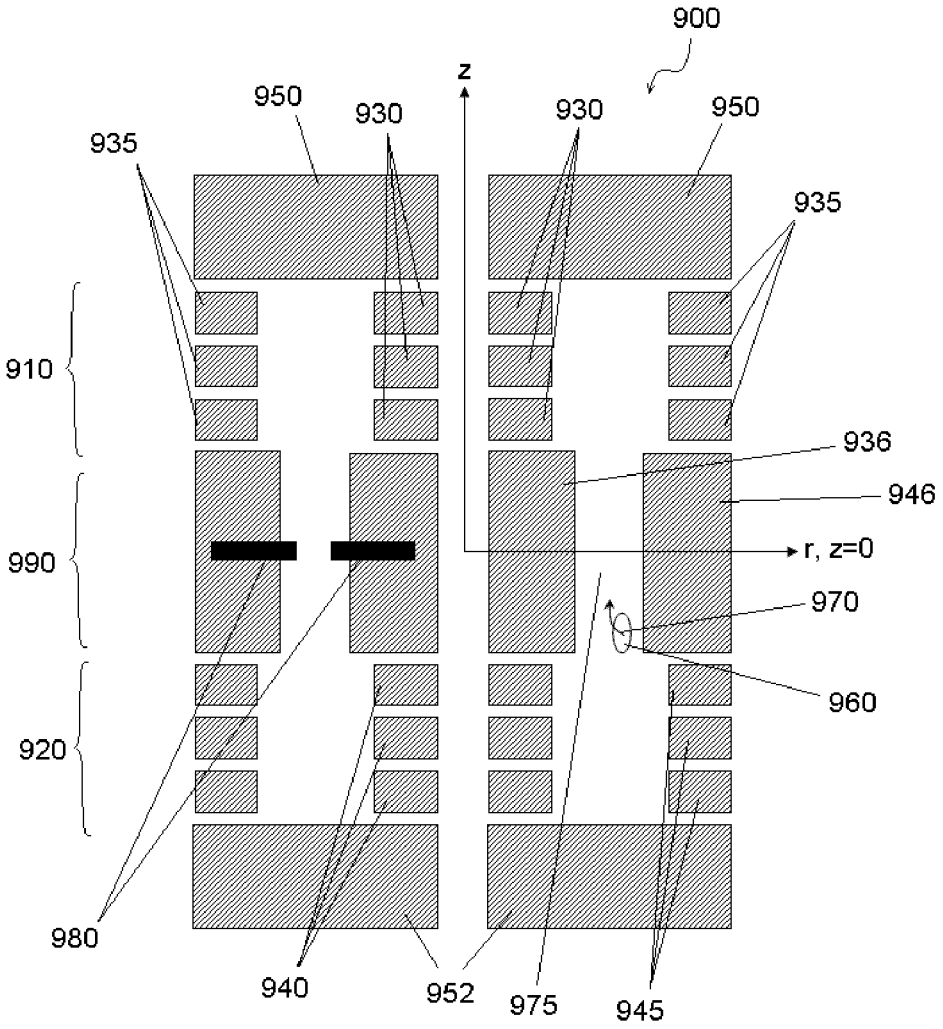
FIG. 10 depicts schematically a cross section of a further analyser of the present invention.

FIG. 10 depicts schematically a cross section of a further analyser of the present invention, 900, comprising two opposing mirrors 910, 920, Each mirror comprises inner and outer field-defining electrode systems, each comprising multiple electrodes. Mirror 910 comprises inner field-defining electrode system comprising electrodes 930 and outer field-defining electrode system comprising electrodes 935. Mirror 920 comprises inner field-defining electrode system comprising electrodes 940 and outer field-defining electrode system comprising electrodes 945. Analyser 900 also comprises inner electrode 936 and outer electrode 946 positioned between the two opposing mirrors. The inner field-defining electrode systems 930, 940 and inner electrode 936 are hollow. Each mirror 910, 920 further comprises field terminating electrodes 950, 952. An entrance slot 960 is provided in electrode 946 and whilst it does not lie in the cross sectional plane of the drawing, is shown for illustrative purposes. Ions 970 enter through entrance slot 960. Electrodes adjacent the main flight path 980 are set into but insulated from inner electrode 936 and outer electrode 946.

In operation, ions 970 are injected into analyser 900 through entrance slot 960 whilst inner electrode 936 is set to the same potential as outer electrode 946 (in this case ground potential). This creates a reduced field region in volume 975. Both mirrors 910, 920 are held with electrode systems 930, 935, 940, 945 energized at this time. Field terminating electrodes 950, 952 are also energized. Because entrance slot 960 lies displaced from the z=0 plane, on entry to analyser 900, ions 970 experience a force in the positive z direction from the electric field within mirror 920 which penetrates into volume 975. Once ions 970 reach a chosen point within the analyser, inner electrode 936 has a potential rapidly applied to it to create an electric field to induce orbital rotation of the ions 970 and the ions 970 commence upon the main flight path. The electrodes 935, 936, 930, 945, 946, 950, 952 are at this time held at potentials so as to create a linear field within each opposing mirror. Once the packet of ions has separated sufficiently, electrodes adjacent the main flight path 980 are periodically energized to constrain the arcuate divergence from the main flight path of ions of interest by applying one voltage to the electrodes 980 when the ions of interest are in the vicinity of the electrodes 980. Unwanted ions are deflected by applying a different voltage to the electrodes 980 when the ions of interest are not in the vicinity of the electrodes 980. When the different voltage is applied to electrodes 980, electrodes 980 also absorb scattered ions. Once a desired degree of mass separation has been achieved, inner electrode 936 is once again set to the same potential as outer electrode 946 (in this case ground potential) and the ions of interest are ejected from the analyser through a further aperture not shown in the figure.

Figure 11A:
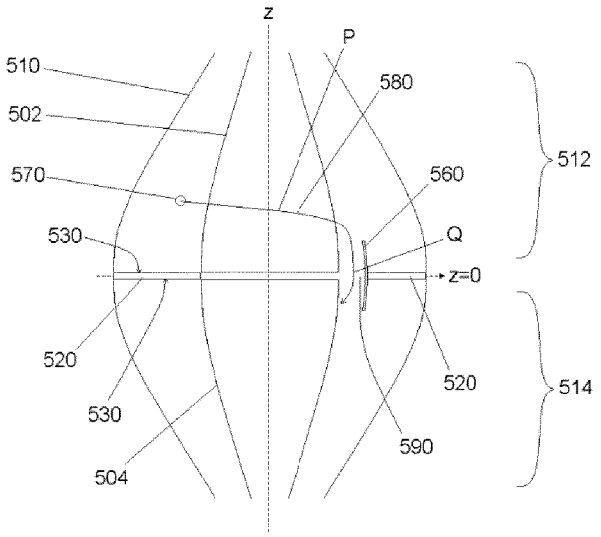
FIG. 11 depicts schematically a further preferred embodiment of the analyser of the present invention.
Figure 11B:
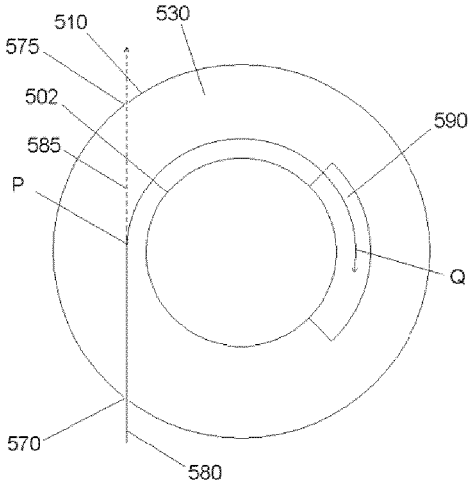

A further preferred embodiment of the analyser of the present invention is depicted schematically in FIG. 11. This analyser is similar to the analyser depicted in FIG. 6 and like components are given the same identifiers. The analyser differs from the example of FIG. 6 in that whereas inner electrode 500 of FIG. 6 formed the inner electrode of both opposing mirrors, in this present example, each mirror 512, 514 includes a separate inner electrode 502, 504. Separate electrodes 502, 504 enables the mirrors 512, 514 to operated independently. This enables ions of interest having multiple ranges of m/z to be selected. Ions of interest of one range of m/z may be ejected from exit aperture 570 located in mirror 512 whilst ions of interest of one or more other ranges of m/z are moving within mirror 514 and are shielded from the changing electric field within mirror 512 during the ejection process. The ejection process within mirror 512 is accomplished by changing the electrical potential applied to inner electrode 502. Using this method, ions of interest comprising multiple ranges of m/z may be selected within the analyser and ejected one range at a time. This method of selective ejection whilst shielding other ions and retaining them within the analyser requires careful matching of the axial and radial oscillation frequencies and preferably the m/z ranges of the ions of interest differ by 5-10% and there are 3-10 different m/z ranges.

Another embodiment includes an array of analysers according to any of the embodiments above. Such an array could be integrated into an instrument as described in WO2008/080604. Where constructed as a parallel array, the resultant increase of channels of analysis could allow parallel mass selection of different sets of ions from the same injection from an external storage device.

More than this, such an array lends itself to miniaturisation using e.g. micro-electromechanical system or any other modern micro-chip technology, wherein the characteristic size of the analyser (for example, the z-length) is reduced down to below 5 mm, preferably below 2 mm. At least one analyser of the array will have such reduced dimensions; preferably all analysers of the array will have such reduced dimensions. While the space charge limit of each analyser is reduced proportionally to voltage across it as well as its size, the further increase of channels of analysis allows a net increase in the total space charge capacity of the system as a whole.

As used herein, including in the claims, unless the context indicates otherwise, singular forms of the terms herein are to be construed as including the plural form and vice versa. For instance, unless the context indicates otherwise, a singular reference herein including in the claims, such as "a" or "an" means "one or more".

Throughout the description and claims of this specification, the words "comprise", "including", "having" and "contain" and variations of the words, for example "comprising" and "comprises" etc, mean "including but not limited to", and are not intended to (and do not) exclude other components.

It will be appreciated that variations to the foregoing embodiments of the invention can be made while still falling within the scope of the invention. Each feature disclosed in this specification, unless stated otherwise, may be replaced by alternative features serving the same, equivalent or similar purpose. Thus, unless stated otherwise, each feature disclosed is one example only of a generic series of equivalent or similar features.

The use of any and all examples, or exemplary language ("for instance", "such as", "for example" and like language) provided herein, is intended merely to better illustrate the invention and does not indicate a limitation on the scope of the invention unless otherwise claimed. No language in the specification should be construed as indicating any non-claimed element as essential to the practice of the invention.

What is claimed is:

1. A method of selecting ions of interest from a beam of ions using an analyser, the method comprising:

(i) providing an analyser comprising two opposing ion mirrors each mirror comprising inner and outer field-defining electrode systems elongated along an analyser axis z, each system comprising at least one electrode, the outer system surrounding the inner system;

(ii) causing the beam of ions to fly through the analyser along a main flight path in the presence of an analyser field so as to undergo within the analyser at least one full oscillation in the direction of the analyser axis whilst orbiting about at least one electrode of the inner field defining electrode system or oscillating between at least two electrodes of the inner field defining electrode system;

(iii) providing at least one set of electrodes adjacent to the main flight path;

(iv) constraining the arcuate divergence from the main flight path of ions of interest by applying one set of voltages to at least one of the sets of electrodes adjacent to the main flight path when the ions of interest are in the vicinity of at least one of the at least one set of electrodes adjacent to the main flight path and applying at least one different set of voltages to the at least one set of electrodes adjacent to the main flight path when the ions of interest are not in the vicinity of at least one of the at least one set of electrodes adjacent to the main flight path; and, (v) ejecting the ions of interest from the analyser.

2. The method of claim 1, wherein the one set of voltages applied to the at least one of the sets of electrodes adjacent to the main flight path constrains the arcuate divergence of the ions of interest and is applied after every i-th reflection in one or both of the mirrors, wherein i is an integer number.

3. The method of claim 1 wherein the at least one different sets of voltages applied to the at least one sets of electrodes adjacent to the main flight path provides a deflecting action causing ions in the vicinity of at least one of the at least one sets of electrodes adjacent to the main flight path whilst the at least one different sets of voltages is applied to be deflected from the main flight path.

4. The method of claim 1 wherein the at least one of the sets of electrodes adjacent the main flight path consist of a single set of electrodes.

5. The method of claim 4 wherein the single set of electrodes consists of a single electrode.

6. The method of claim 1 wherein the analyser further comprises a disc at least partly spanning the space between the inner and outer field defining electrode systems and lying in a plane perpendicular to the analyser axis, the disc comprising a slot for transmission of ions and having resistive coating upon both faces, the resistive coating biased so that the presence of the disc does not substantially distort the field within the analyser from the form of the analyser field in the absence of said disc.

7. The method of claim 6 wherein at least one of the sets of electrodes adjacent to the main flight path is mounted upon the disc.

8. The method of claim 1 wherein at least one of the sets of electrodes adjacent the main flight path is located adjacent to or set into at least one of the inner or outer field defining electrode systems of one or both mirrors.

9. The method of claim 1 wherein a third set of voltages is applied to at least one of the sets of electrodes adjacent the main flight path.

10. The method of claim 1 wherein ions enter the analyser through an entry aperture in one or both of the outer field defining electrode systems at a time when the analyser field is switched to a first intensity; and the analyser field is switched to a second intensity when ions of interest reach the main flight path, the second intensity being such that the ions of interest commence to travel upon the main flight path.

11. The method of claim 10 wherein ions enter the analyser in a direction perpendicular to the analyser axis z at a turning point within one of the opposing ion mirrors.

12. The method of claim 1 wherein when ions of interest reach a suitable point upon the main flight path the analyser field is switched from one intensity to a different intensity, the different intensity being such that said ions of interest leave the main flight path and travel through an exit aperture in one or both the outer field defining electrode systems to leave the analyser.

13. The method of claim 11 wherein ions are ejected from the analyser in a direction perpendicular to the analyser axis z at a turning point within one of the opposing ion mirrors.

14. The method of claim 12 wherein once the analyser field is switched from one intensity to the different intensity unwanted ions fail to travel through the exit aperture in one or both the outer field defining electrode systems to leave the analyser.

15. The method of claim 12 wherein: ions enter the analyser through an entry aperture in one or both of the outer field defining electrode systems at a time when the analyser field is switched to a first intensity; the analyser field is switched to a second intensity when ions of interest reach the main flight path, the second intensity being such that the ions of interest commence to travel upon the main flight path; and the entry and exit apertures lie upon a straight line.

16. The method of claim 10 wherein fringe field correction optics are located adjacent to either or both of the entry aperture and an exit aperture, and the fringe field correction optics comprise electrodes energized in one of two states: one state during a time when ions pass through the entry and/or exit apertures and a second state during the time when ions are flying through the analyser along the main flight path in the presence of the analyser field.

17. The method of claim 10 wherein a pulsed ion source is located upstream of the analyser to supply the beam of ions to the analyser such that time of flight separation of ions occurs before said beam of ions enter the analyser.

18. The method of claim 1 wherein the at least one set of electrodes adjacent to the main flight path are located at a z=0 plane.

19. The method of claim 1 wherein the ions of interest comprise ions of a plurality of ranges of m/z.

20. The method of claim 1 wherein the analyser is used to select ions of at least one narrow range of m/z for fragmentation in a fragmentation means and subsequent mass analysis, wherein the fragmentation means is used to implement any of: collision induced dissociation (CID, higher energy collisional dissociation (HCD), electron transfer dissociation (ETD), electron capture dissociation (ECD) and surface induced dissociation (SID), and the subsequent mass analysis is performed using any of the following analysers: electrostatic orbital trap, Fourier transform ion cyclotron resonance (FT-ICR), single- or multi-reflection TOF, electrostatic traps, RF ion traps, quadrupole, magnetic sector.

21. The method of claim 1 wherein the analyser comprises entrance and exit apertures that lie upon a straight line and which operates in a first mode wherein ions of at least one range of m/z are selected and ejected from the analyser and unwanted ions are not ejected from the analyser, and in a second mode wherein ions fly through the analyser along the straight line upon which the entry and exit apertures lie.

22. The method of claim 1 wherein the step of providing an analyser includes providing a plurality of analysers arranged as a parallel array.

23. The method of claim 22 wherein the z-length of at least one of the analysers is less than 5 mm.

24. The method of claim 22 wherein the z-length of at least one of the analysers is less than 2 mm.

* * * * *